US008339356B2

(12) United States Patent
Utsumi et al.

(10) Patent No.: US 8,339,356 B2
(45) Date of Patent: Dec. 25, 2012

(54) LIQUID CRYSTAL DISPLAY APPARATUS CAPABLE OF MAINTAINING HIGH COLOR PURITY

(75) Inventors: Yuka Utsumi, Hitachi (JP); Yasushi Tomioka, Hitachinaka (JP); Akitoyo Konno, Hitachi (JP); Katsumi Kondo, Mito (JP)

(73) Assignees: Hitachi Displays, Ltd., Chiba (JP); Panasonic Liquid Crystal Display Co., Ltd., Hyogo-ken (JP)

( * ) Notice: Subject to any disclaimer, the term of this patent is extended or adjusted under 35 U.S.C. 154(b) by 181 days.

(21) Appl. No.: 13/022,140

(22) Filed: Feb. 7, 2011

(65) Prior Publication Data

US 2011/0128306 A1 Jun. 2, 2011

Related U.S. Application Data

(63) Continuation of application No. 11/156,658, filed on Jun. 21, 2005, now Pat. No. 7,893,903.

(30) Foreign Application Priority Data

Jun. 21, 2004 (JP) ..... 2004-182421

(51) Int. Cl.
*G09G 3/36* (2006.01)

(52) U.S. Cl. ..... 345/102; 345/690; 359/237

(58) Field of Classification Search ..... 345/690, 345/38, 41, 50–54, 64, 87–104; 349/61; 359/237

See application file for complete search history.

(56) References Cited

U.S. PATENT DOCUMENTS 6,122,002 A * 9/2000 Ohara et al. ..... 348/191
6,144,359 A 11/2000 Grave
6,529,212 B2 3/2003 Miller
6,762,741 B2 7/2004 Weindorf
2001/0038371 A1 11/2001 Yoshinaga
2001/0043179 A1 11/2001 Yoshinaga
2002/0057238 A1 5/2002 Nitta
2002/0140656 A1 * 10/2002 Yoshioka ..... 345/89
2003/0001810 A1 1/2003 Yamaguchi
2003/0206163 A1 11/2003 Kee
2003/0222884 A1 12/2003 Ikeda (Continued)

FOREIGN PATENT DOCUMENTS

JP 10-240145 9/1998

(Continued)

*Primary Examiner* — Amare Mengistu
*Assistant Examiner* — Vinh Lam
(74) *Attorney, Agent, or Firm* — Antonelli, Terry, Stout & Kraus, LLP.

(57) ABSTRACT

A liquid crystal display apparatus includes a white color light source and a coloring light source, a detection circuit which detects a brightness of an input image signal, an image quality processing calculation circuit, a light source control circuit, and an image control circuit. The coloring light source includes a blue light source. The image quality processing calculation circuit outputs to the light source control circuit a light source control signal for (1) increasing a light intensity of the coloring light source when an average luminance of the input image signal is detected to be higher than a predetermined luminance based on a detection result of the detection circuit, and for (2) turning-on only the white color light source without turning-on the coloring light source when the average luminance of the input image signal is detected to be lower than the predetermined luminance.

14 Claims, 15 Drawing Sheets

U.S. PATENT DOCUMENTS

| | | | | |
|---|---|---|---|---|
| 2004/0051692 | A1* | 3/2004 | Hirakata et al. | 345/102 |
| 2004/0246275 | A1 | 12/2004 | Yoshihara | |
| 2005/0116917 | A1* | 6/2005 | Aoki | 345/99 |
| 2006/0007089 | A1 | 1/2006 | Lee | |
| 2006/0208998 | A1* | 9/2006 | Okishiro et al. | 345/102 |
| 2007/0268234 | A1* | 11/2007 | Wakabayashi et al. | 345/102 |

FOREIGN PATENT DOCUMENTS

| | | |
|---|---|---|
| JP | 2003-140110 | 5/2003 |
| JP | 2003-167552 | 6/2003 |
| JP | 2003-331608 | 11/2003 |

* cited by examiner

LIQUID CRYSTAL DISPLAY APPARATUS CAPABLE OF MAINTAINING HIGH COLOR PURITY

CROSS REFERENCE TO RELATED APPLICATION

This application is a continuation of U.S. application Ser. No. 11/156,658, filed Jun. 21, 2005 now U.S. Pat. No. 7,893,903, the contents of which are incorporated herein by reference.

BACKGROUND OF THE INVENTION

The present invention relates to a liquid crystal display apparatus capable displaying a high quality image by maintaining a high color purity in the range from a low luminance to a high luminance by reducing a tone change between grey scales or gradation levels and by optimizing a display image by adjusting a light source (back light) in accordance with a brightness of image signals.

The application field of a liquid crystal display has been expanded because it is thinner and lighter in weight than a cathode ray tube (CRT) having had a main trend of conventional display apparatuses and because of developments and advancements of angle of view enlarging technologies and moving image technologies.

As liquid crystal display apparatuses have expanded recently their use as monitors for desk-top type personal computers, monitors for printing and designing, and liquid crystal televisions, there are high needs for high color purity of red, green and blue and for color reproductivity of grey scales such as complexion. In the application to liquid crystal televisions, a high contrast ratio is required among other things, and not only a wide dynamic range of luminance but also color reproductivity from low luminance to high luminance is required. Liquid crystal display apparatuses are, however, associated with the problem that a color tone is likely to be changed with a change in luminance, i.e., a change in grey scale or gradation.

In order to achieve high luminance and high color purity, JP-A-2003-331608 describes the techniques of using a plurality type of light sources having different luminous colors and operating the light sources in two different modes, a color purity mode and a high luminance mode. As the techniques of improving moving image response characteristics and achieving a high luminance, JP-A-2003-140110 describes the configuration having a cold cathode fluorescent lamp and a light emitting diode array.

SUMMARY OF THE INVENTION

Different tones between grey scales are a severe problem for a liquid crystal display apparatus, particularly for printing and designing monitors. Not only the color reproductivity but also the expanded dynamic range of luminance are necessary for liquid crystal televisions and both are required to be satisfied. However, a liquid crystal display apparatus of the type that an image is displayed by utilizing birefringence of liquid crystal has the problem that color purity at high or low gray scale level is lowered by the wavelength dispersion characteristics of refractive index anisotropy of liquid crystal material, depolarization components existing between a pair of polarizers, and the like.

There is other influences of human visual perception. When a person looks at an image such as a movie having a low average luminance (APL: Average Picture Level) in a lowered illumination environment, i.e, in a dim light vision state, human visual perception for red chromaticness lowers greatly and senses bright the colors from blue to greenish blue because of the Purkinje phenomena. Under these conditions, red color purity lowers considerably and achromatic colors such as grey and black, complexion and the like are visually recognized as a bluish image, because of the polarizer characteristics and depolarization members.

A tone shift to blue at a low luminance occurs also from the characteristics of a liquid crystal display mode. For example, a transmittance T in a vertical alignment mode is expressed by the following equation.

$$T=\tfrac{1}{2}(\sin^2(\pi\Delta nd))-\tfrac{1}{2}(\sin^2(\pi\Delta nd/\lambda))$$

where Δn is refractive index anisotropy of liquid crystal, d is a thickness of a liquid crystal layer, and λ is a wavelength.

In the vertical alignment mode, as an electric field is applied, the alignment of liquid crystal molecules is inclined so that an effective Δnd changes to control the transmittance which is different at each wavelength. In a normally close type, an intensity of transmission light having a short wavelength is high in a low gray scale level, whereas an intensity of transmission light having a long wavelength is high in a high gray scale level. Even if the tone of grey scale can be controlled by independently controlling the transmittance of each pixel of red, green and blue of a liquid crystal panel, it is impossible to compensate for bluish black caused by a subject member and human visual perception, and to realize white at a high luminance because an intensity of blue transmission light becomes low.

JP-A-2003-331608 discloses an adjusting unit for adjusting a chromaticity of white by controlling light sources having different luminous colors. According to this technique, although the color purity at a high luminance can be increased, it cannot compensate for a lowered color purity at a low luminance. Although JP-A-2003-140110 discloses the technique of using light sources of a cold cathode fluorescent lamp and a light emitting diode array to expand the luminance dynamic range and improve the moving image characteristics, this technique cannot realize a high color purity.

Although a high color purity at a high luminance has been studied heretofore as described above, no studies have been made on an issue of maintaining high a color purity, expanding a luminance dynamic range and achieving a high contrast ratio.

It is therefore an object of the present invention to provide a liquid crystal display apparatus capable of displaying an image in a wide dynamic range of luminance and maintaining a high color purity in the range from a low luminance to a high luminance.

According to one aspect of the present invention, there is provided a liquid crystal display apparatus comprising: first white color light sources and second coloring light sources respectively for irradiating light upon a liquid crystal panel for displaying an image; a detection circuit for detecting a brightness of an input image signal; and an image quality processing calculation circuit for outputting a light source control signal and an image control signal in accordance with a detection result by the detection circuit, the light source control signal controlling an intensity of the second coloring light sources, and the image control signal controlling an image to be displayed on the liquid crystal panel.

In the liquid crystal display apparatus of the present invention, input image signals are processed in accordance with the average luminance, maximum luminance and minimum luminance of the input image signals, the tones of the light sources and an image to be displayed on the liquid crystal panel are controlled to display an image of high quality. The present invention is applicable to a normally close type liquid crystal display apparatus of a display mode utilizing birefringence of liquid crystal, and particularly to liquid crystal display apparatuses requiring color reproductivity and a high contrast ratio, such as liquid crystal televisions.

Other objects, features and advantages of the invention will become apparent from the following description of the embodiments of the invention taken in conjunction with the accompanying drawings.

DESCRIPTION OF THE EMBODIMENTS

Figure 1:
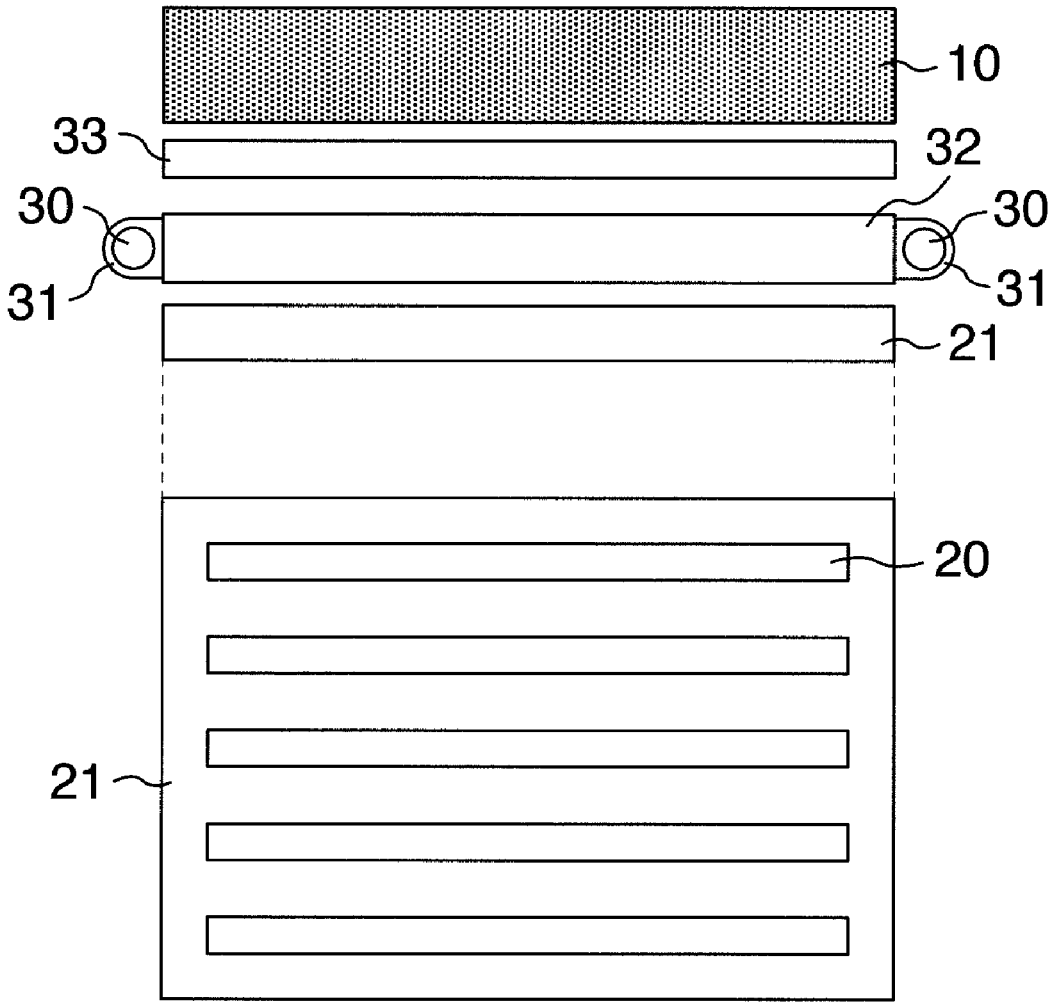
FIG. 1 is a basic structural diagram of a liquid crystal display apparatus according to the present invention.

Prior to describing embodiments of the present invention, the outline of the present invention will be described with reference to FIGS. 1 to 3.

A liquid crystal display apparatus of the present invention comprises: light sources to be disposed on a back side of a liquid crystal panel 10, the light sources including first white color light sources 20 constituted of three primary color components, red, green and blue and second coloring light sources 30 for independently emitting light of at least one of light three primary color components, red, green and blue; a brightness detection circuit 1 for detecting an average luminance, a maximum luminance, a minimum luminance and the like of input image signals; an image quality processing calculation circuit 2 for outputting a light source control signal for controlling intensities of the light sources 20 and 30 and an image control signal for controlling an image to be displayed on the liquid crystal panel 10, in accordance with a detected brightness; a light source control circuit 3 for controlling the first white color light sources 20 and the second coloring light sources 30, in accordance with the light source control signal; and an image control circuit 4 for displaying an optimized image on the liquid crystal panel 10 in accordance with the image control signal.

The liquid crystal display apparatus of the present invention can prevent a change in a white display to yellow and display achromatic white and high luminance blue respectively at a maximum luminance, and display an image at a high color purity by suppressing a change to blue and a reduction in red purity, at a low luminance.

In an embodiment of the present invention, a transmission type liquid crystal display apparatus having light sources on a back side of a liquid crystal panel 10 has first white color light sources 20 emitting generally white light and a second coloring light sources 30 disposed on at least one side of a light pipe 32 disposed just under the liquid crystal panel, the second coloring light sources 30 emitting at least red and/or blue color light. The white color light source is not intended to emit achromatic white light defined strictly by color engineering, but it is a general light source used for liquid crystal display apparatuses. For example, a light source having a color temperature of 5000 K to 15000 K is used for the light source of a liquid crystal display apparatus. The light source in this color temperature range is used as the first white color light source.

The image quality processing calculation circuit 2 of the present invention has look-up tables for light source control and image control, and in accordance with a brightness of image signals and the transmission characteristics of the liquid crystal panel 10, generates the light source control signal for adjusting the light sources by referring to the light source control look-up table, and generates the image control signal for controlling an image to be displayed on the liquid crystal panel by referring to the image control look-up table.

The first white color light sources 20 and the second coloring light sources 30 for red and/or blue are disposed just under the liquid crystal panel.

In this case, the second coloring light sources 30 are preferably disposed in between the first coloring light sources 20. For example, a light emitting diode array may be dispose near the first white color light sources or red and/or blue light emitting diodes may be disposed distributively.

In order to mix light from the first white color light sources 20 and second coloring light source 30, it is preferable to dispose a diffusion plate 33 between the liquid crystal panel 10 and a light source accommodating unit 31.

The first white color light sources 20 accommodated in a back light case 21 may be narrow peak band emitted phosphor type fluorescent lamps, light emitting diodes, or organic electroluminescence elements (hereinafter called "organic EL"). Similarly, the second coloring light sources 30 may be red and/or blue narrow peak band phosphor type fluorescent lamps, red and/or blue light emitting diodes, or red and/or blue organic ELs.

The liquid crystal panel 10 may have white pixels in addition to red, green and blue pixels, constituting a base unit of four pixels.

The liquid crystal panel 10 of the four-pixel configuration is illuminated with back light from the first white color light sources 20 and second coloring light sources 30, and is suitable for displaying an image having a very high luminance as requested by computer graphics or the like.

A peripheral environment brightness detection circuit 5 may be provided to detect a brightness of a peripheral environment of the liquid crystal display panel.

FIG. 1 is a schematic diagram showing an example of a liquid crystal display apparatus according to the present invention. A light source disposed on the back side of a liquid crystal panel 10 is constituted of first white color light sources 20 accommodated in a back light case 21, the first white color light sources emitting nearly white color light, and second coloring light sources 30 accommodated in a light source accommodating unit 31. The second coloring light sources 30 are disposed on at least one side of a light pipe 32 disposed on the back side of the liquid crystal panel 10. The light pipe 32 is used for guiding light from the first white color light sources 20 and second coloring light sources 30 to the back surface of the liquid crystal 10 to transmit the light through the liquid crystal panel 10 to the front surface thereof. A diffusion plate 33 is disposed between the liquid crystal panel 10 and light pipe 32 to mix light beams (back light beams) from the light sources and uniformalize them.

Figure 2:
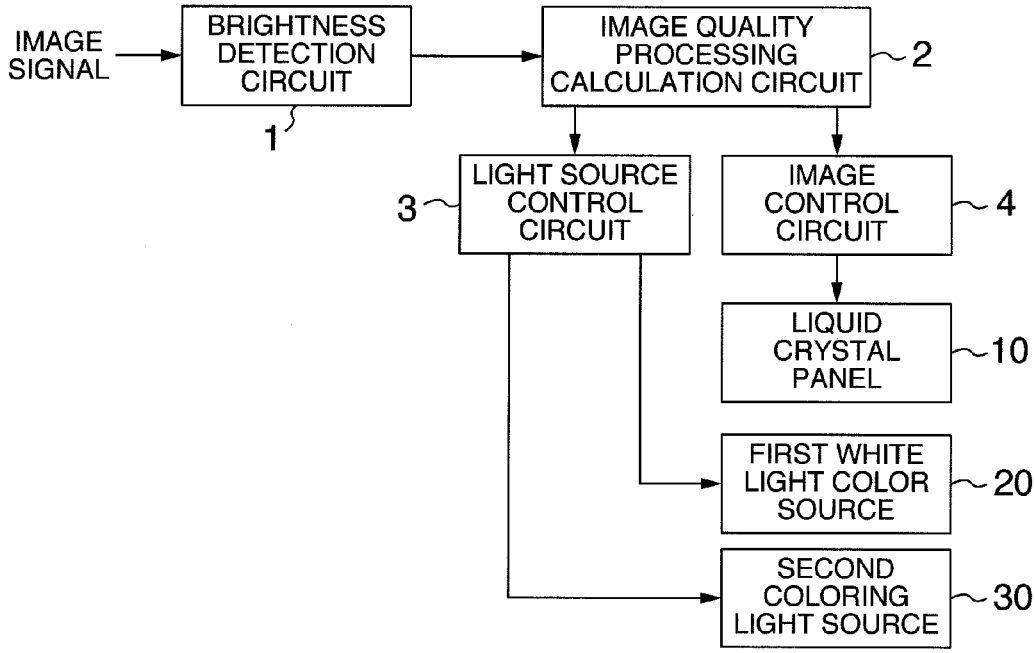
FIG. 2 is a circuit diagram of the liquid crystal display apparatus according to the present invention.

FIG. 2 is a diagram showing an example of the structure of a liquid crystal display apparatus according to the present invention. A brightness detection circuit 1 detects an average luminance, a maximum luminance and a minimum luminance of input image signals and supplies the detected results to an image quality processing calculation circuit 2. In accordance with the detected results, the image quality processing calculation circuit 2 supplies a light source control circuit 3 with a light source control signal, and an image control circuit 4 with an image control signal. In accordance with the light source control signal, the light source control circuit 3 controls to turn on and off the first white color light sources 20 and second coloring light sources 30. The image control circuit 4 displays an image on the liquid crystal panel 10 in accordance with the image control signal (including a corrected image signal and horizontal/vertical sync signals for scanning the liquid crystal panel). These controls are executed in the following embodiments.

Figure 3:
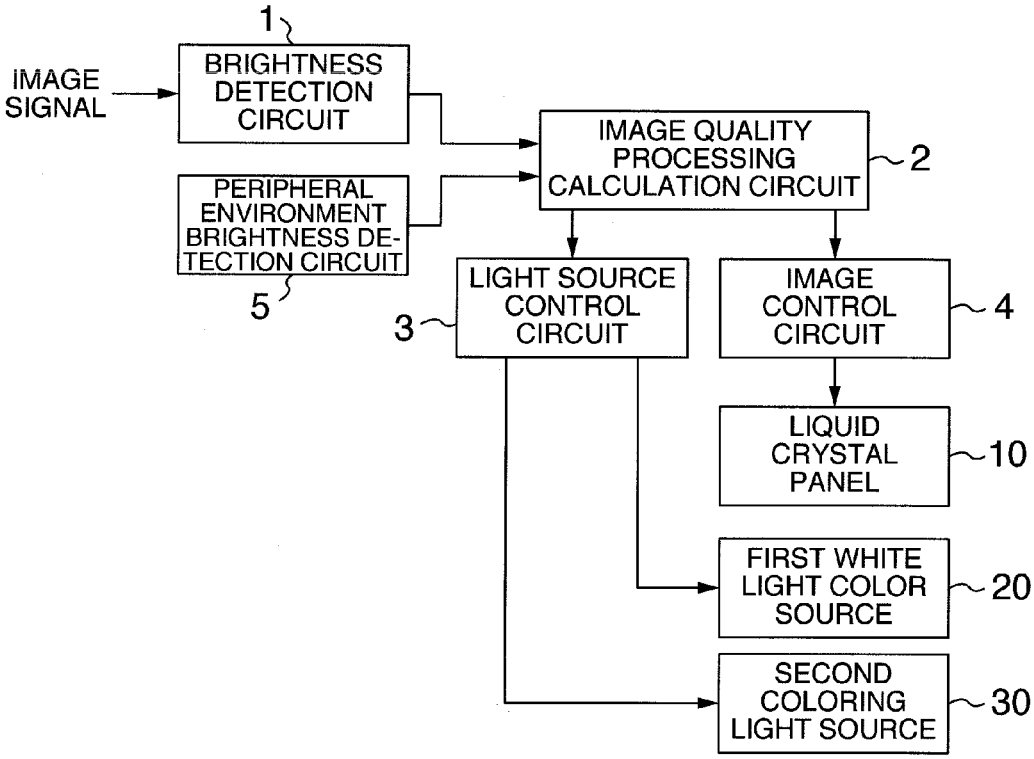
FIG. 3 is another circuit diagram of the liquid crystal display apparatus according to the present invention.

FIG. 3 shows another structure of the liquid crystal display apparatus in which a peripheral environment brightness detection circuit 5 for detecting a brightness of a peripheral environment where the liquid crystal display apparatus is installed, is added to the structure shown in FIG. 2.

In a dim environment having an illuminance of several tens lx, human visual perception is dim light vision, and in a dark room state, it is dim light vision. These visions of human visual perception are different from bright light vision in a normal bright environment because the wavelength most sensitive to light is 550 nm for bright light vision, and 507 nm for dim light vision and it is considered that the most sensitive wavelength for dim light vision is near 507 nm for dim light vision although its visual sensitivity characteristics are still indefinite.

Since human visions are different between a bright environment and a dark environment, the peripheral environment brightness detection circuit 5 detects a brightness of the peripheral environment and in accordance with the detection result, the image quality processing calculation circuit 2 controls the light source control circuit 3 and image control circuit 4 to thereby display an image matching the environment.

Next, with reference to FIGS. 4 to 6, description will be made on the fundamental concept of control to be performed by the image quality processing calculation circuit 2.

Figure 4:
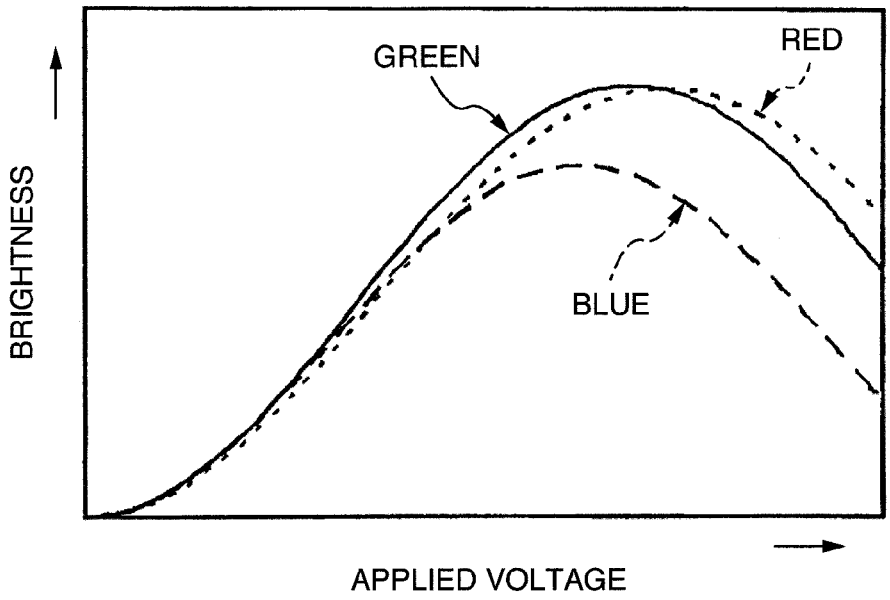
FIG. 4 is a graph showing a relation between an applied voltage and a brightness of each pixel of a liquid crystal panel in a vertical alignment mode.

FIG. 4 shows an example of the relation between a voltage applied to a liquid crystal panel and a brightness, in which an effective $\Delta nd$ changes with an electric field in the vertical alignment mode. Paying attention to intensity ratios among red, green and blue, it can be seen from this graph that at a low electric field, i.e., at a low luminance, the intensity of blue is stronger than or nearly equal to that of green, and at a middle to high luminance, the intensity of blue becomes considerably low. This means that the intensity of blue becomes insufficient in a high luminance display. It is therefore urged to select either increasing yellow or using the luminance of blue having an insufficient intensity as the maximum luminance.

Figure 5:
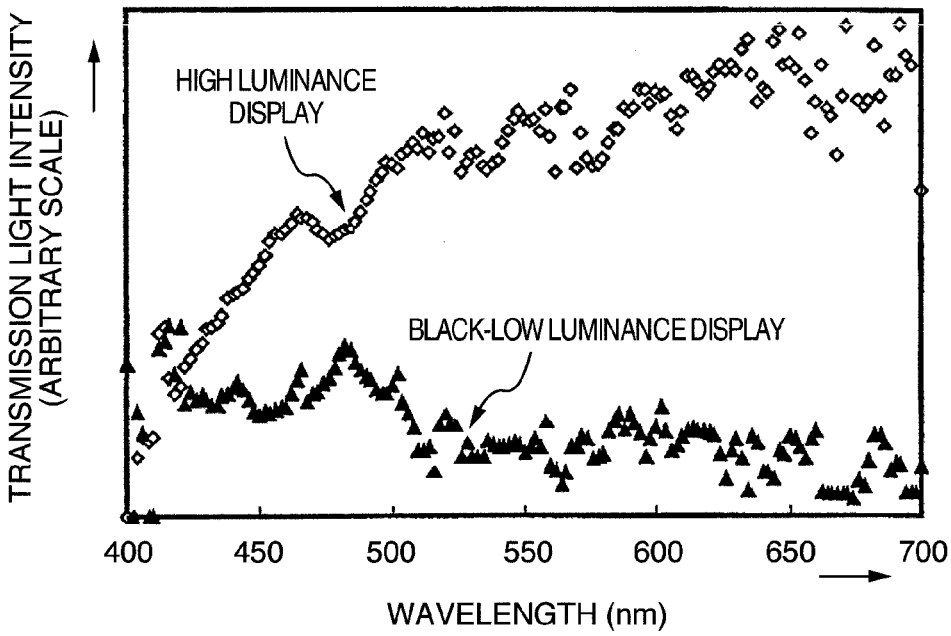
FIG. 5 is a spectrum diagram showing a black to lower gray scale and a higher gray scale on a liquid crystal panel of an in-plane switching mode.

FIG. 5 shows an example of the spectral characteristics of high luminance display and black to low luminance display on a liquid crystal panel of a birefringence display type. The scale of the ordinate of a transmission light intensity is arbitrary. It can be seen from the comparison between maximums and minimums of the spectral characteristics that in the black to low luminance display, the intensity is high at 500 nm or shorter, i.e., the intensity of blue is high, and in the high luminance display, the intensity near at 600 nm is high. It can be known from this that a liquid crystal panel having the characteristics that an image is bluish at a black to low luminance and yellowish at a high luminance.

Therefore, if the average luminance (APL) of image signals is low, only the first white color light sources 20 are turned on, and for the high luminance display, the second coloring light sources 30 for blue are turned on to raise the color temperature of the light sources. The image quality processing calculation circuit 2 controls the color temperature of the light sources in this manner, and outputs a corresponding image control signal so that the intensity of blue can be prevented from being lowered.

If fluorescent lamps are used for the second coloring light sources 30, the luminance control range of the fluorescent lamp is narrower than that of a light emitting diode or an organic EL. However, it is not necessary in practice to control the intensity of blue of the second coloring light sources 30 very strong, so that even the fluorescent lamps can compensate for blue sufficiently.

It is generally said that a turn-on/off speed of a fluorescent lamp is slow. However, a practically problematic low speed is a fluorescent lamp using green phosphor, and a turn-on/off speed of the fluorescent lamps for blue and red is very fast.

For example, if $LaPO_4$:Tb, Ce is used as green phosphor, the rise (turn-on) speed is about 5 msec and a fall (turn-off) speed is about 6 msec, if BAM:Eu is used as blue phosphor, the rise and fall speeds are 0.1 msec or shorter, and if $Y_2O_3$:Eu is used as red phosphor, the rise and fall speeds are about 3 msec or shorter.

There is no problem in flashing back light of blue and red for improving the quality of moving images, because it is said that human visual perception is insensitive to a response of 4 msec or shorter.

As described above, it is therefore effective if fluorescent lamps are used as the second coloring light sources 30. The intensity of the first white color light sources 20 may also be adjusted if the peripheral environment is dark and both the average luminance and maximum luminance are sufficiently low. This light adjustment may be made through either current control or frequency modulation. This selection may be made by the image quality processing calculation circuit 2. The intensity of blue can be compensated in this manner.

Next, intensity compensation for red will be described. Red compensation is required mainly for image signals at a low luminance. As shown in FIG. 5, even if black is displayed, the liquid crystal panel transmits blue light more or less. This may be ascribed to the influence of the polarizers and a depolarization member disposed between the polarizers and liquid crystal panel. Red displayed at a low luminance is mixed with blue or green transmission light so that a red color purity lowers greatly. For the low luminance display, the image quality processing calculation circuit 2 lowers the intensity of the first white color light sources 20 and turns on the second coloring light sources 30 for red.

Figure 6:
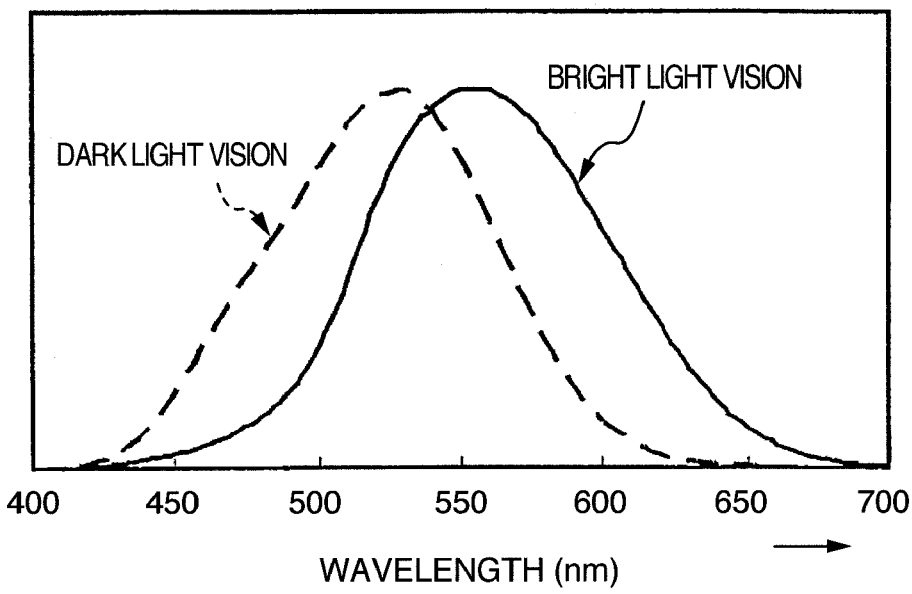
FIG. 6 is a graph showing human visual sensitivities.

There is another issue of human visual perception as shown in FIG. 6. As described earlier, in the dark environment, blue light is highly sensitive whereas red light becomes hard to be sensitive. This is because the so-called Purkinje phenomena occur. In the dark environment, therefore, in accordance with the detection result of the detection circuit 5 for detecting a brightness of the peripheral environment, the image quality processing calculation circuit 2 controls to lower the intensity of the first white color light sources 20 and turn on the second coloring light sources 30. However, if the average luminance of image signals is high in the dark peripheral environment, the Purkinje phenomena disappear so that the intensity of only the first white color light sources may be lowered.

Both blue and red may be compensated, or one of blue and red may be compensated. For example, if a liquid crystal panel having sufficiently strong bluish is used, only the second coloring light sources 30 for red are used, or the color temperature of the first white color light sources 20 is set low and only the second coloring light sources for blue are used.

In another configuration, the second coloring light sources 30 are always turned on. Namely, the intensity of green of the first white color light sources 20 is set high, and the second coloring light sources 30 for blue and red are always turned on with a controlled color temperature. When low intensity and high luminance image signals are detected, the image quality processing calculation circuit 2 adjusts the intensity of the second coloring light sources 30. Raising the intensity of green of the first white color light sources 20 is effective in terms of efficiency, and it becomes possible to raise the luminance of the light sources.

Embodiments of the present invention will be described with reference to FIGS. 7 to 25.

First Embodiment

In the first embodiment, for the light sources disposed on the back side of the liquid crystal panel 10 shown in FIG. 1, cold cathode fluorescent lamps having a diameter of 2 mm and made of narrow peak band emitted phosphor were juxtaposed in the back light case 21, as the first white color light sources 20 disposed just under the liquid panel 10, and red cold cathode fluorescent lamps accommodated in the light source accommodating unit 31 were disposed along two sides of the light pipe 32 (made of ZEONOR manufactured by ZEON CORPORATION), as the second coloring light sources 30. The diffusion plate 33 was disposed between the light pipe 32 and liquid panel 10.

Since the intensity of the second coloring light sources 30 are not necessary to be as strong as that of the first white color light sources 20, a light pipe type is used so that the number of second coloring light sources 30 can be reduced to suppress a consumption power. The color mixture degree is also improved. In the second embodiment, although the second coloring light sources 30 are disposed on the shorter sides of the liquid crystal panel 10, they may be disposed on the longer sides by using the light pipe type. In this embodiment, a 32-inch in-plane switching type liquid crystal panel was used as the liquid crystal panel 10. Twelve first white color light sources 20 were used, and two second coloring light sources 30 were disposed on both sides.

The image quality processing calculation circuit 2 shown in FIG. 2 supplies the light source control circuit 3 with the light source control signal to turn on only the first white light sources 20, if the average luminance of input image signals is thirty three gray scale levels or higher (in this embodiment, the minimum gray scale level is 0 and the maximum gray scale level is 255) or if the average luminance of input image signals is thirty two gray scale levels or lower and the maximum luminance is one hundred and sixty two gray scale levels or higher.

If the average luminance of input image signals is thirty two gray scale levels or lower and the maximum luminance is one hundred and sixty one gray scale levels or lower, the image quality processing calculation circuit 2 refers to the image control look-up table, corrects the gamma characteristics of the image signals, and supplies the image control circuit 4 with the image control signal including the corrected image signals and horizontal/vertical sync signals for scanning the liquid crystal panel 10. At the same time, the image quality processing calculation circuit 2 refers to the light source control look-up table, and supplies the light source control circuit 3 with the light source control signal to turn on red fluorescent lamps of the second coloring light sources 30.

Figure 7:
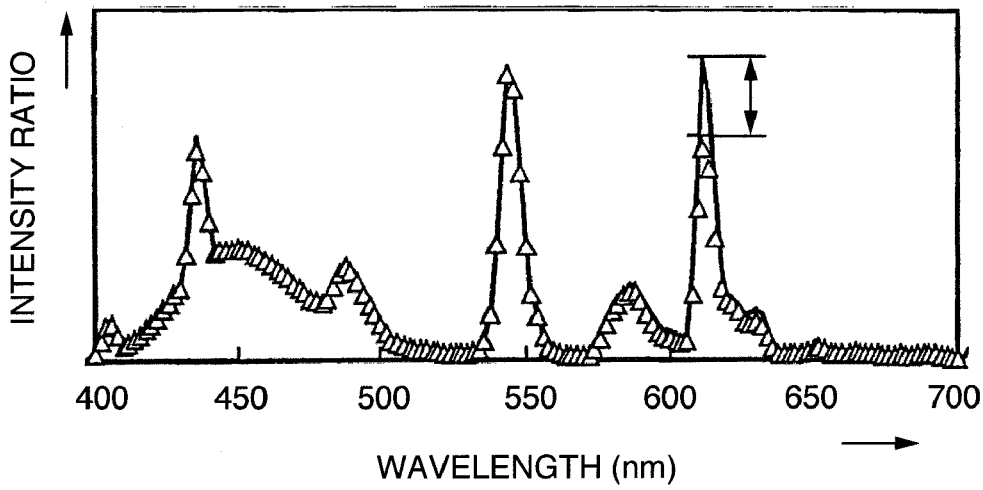
FIG. 7 is a graph showing the luminous characteristics of spectrum intensity ratios in a tone control of the light sources of a first embodiment.

FIG. 7 shows the luminous characteristics of light sources when only the first white color light sources 20 are tuned on and red fluorescent lamps of the second coloring light sources 30 are turned on. A portion where the red luminous intensity becomes strong when the red fluorescent lamps are turned on, is indicated by a both-pointed arrow. The image quality processing calculation circuit 2 has the light source control look-up table based on the luminous characteristics.

Comparative Example

A typical example not executing the above-described control will be described with reference to the chromaticity diagram shown in FIG. 25.

Figure 25:
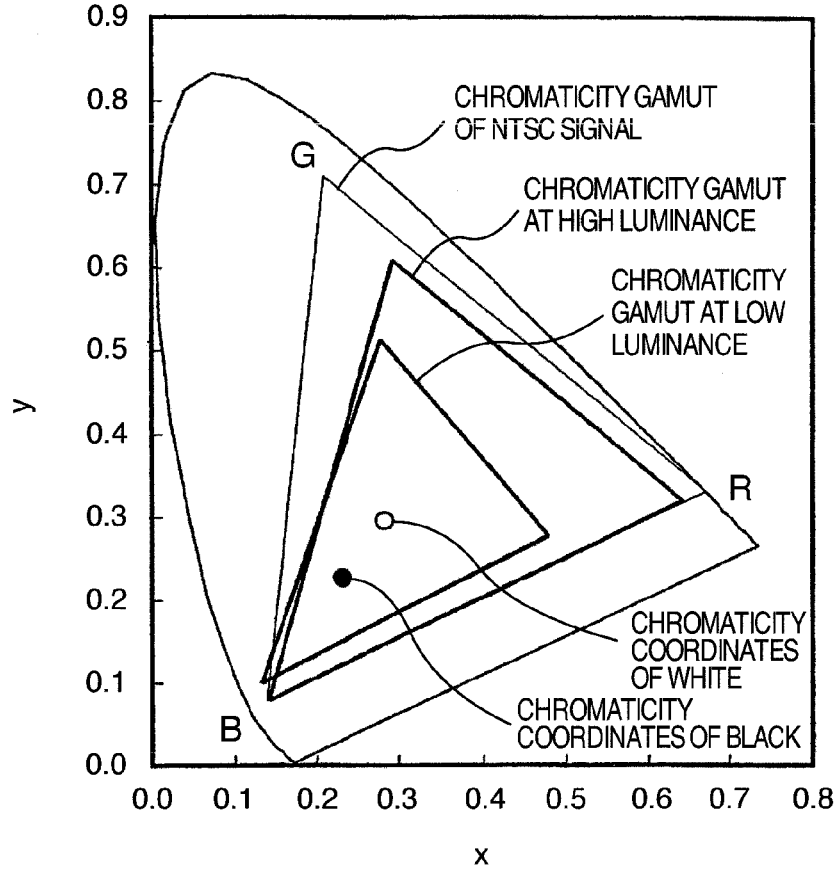
FIG. 25 is a chromaticity diagram showing color gamuts and black and white states of a conventional liquid crystal display apparatus.

Referring to FIG. 25, the chromaticity coordinates of NTSC television signals are generally defined (0.67, 0.33) for red (R), (0.21, 0.71) for green (G) and (0.14, 0.08) for blue (B). An area of a triangle surrounded by these chromaticity coordinates is a color gamut of the NTSC television signals.

A liquid crystal display apparatus has generally a color gamut at a high luminance which is 72% of the color gamut of NTSC, as shown in FIG. 25. Namely, if primary colors RGB are displayed at the maximum luminance, red has the coordinates (0.64, 0.32), green has the coordinates (0.29, 0.61) and blue has the coordinates (0.14, 0.78), these chromaticity coordinates being at the maximum luminance of each color.

However, the liquid crystal display apparatus cannot maintain this color gamut at a low luminance. For example, as shown in FIG. 25, the color gamut at the low luminance is defined by (0.47, 0.27) for red, (0.28, 0.51) for green and (0.13, 0.10) for blue. With this color gamut, the numbers of red and green colors are reduced. Red is recognized with human eyes as the most degraded color purity. This is ascribed to that differences between colors recognized with human eyes are not equidistant on the xy chromaticity diagram and that a reduced number of red colors become conspicuous whereas a reduction in the number of green colors is relatively hard to be recognized.

There is another problem that the chromaticity coordinates of black and white change. Designs are performed generally to adjust the chromaticity of white. In FIG. 25, the white chromaticity coordinates are set to (0.28, 0.29) which are slightly bluish white more than the chromaticity coordinates (0.3101, 0.3161) of achromatic color on the chromaticity diagram, e.g., a standard light source C as the day light conditions. Since the chromaticity of white is largely dependent upon user preference, it is generally set in accordance with user preference.

The problem is that as compared to the set chromaticity of white, black color is displayed very bluish. In FIG. 25, the black chromaticity coordinates are (0.23, 0.21) which are bluish.

The present invention aims to alleviate the above-described two problems, a degraded red color purity and bluish black display at a low luminance. Namely, targets are to set the red coordinates at a low luminance nearer to those at a high luminance and to set the black chromaticity near to the white chromaticity.

The first embodiment will be described with reference to the chromaticity diagram shown in FIG. 25. The chromaticity coordinates of the first white color light sources 20 of the first embodiment are (0.28, 0.26). The intensity of the second coloring light sources is about 0.25 of the red luminous intensity of the first white color light sources 20, i.e., the red light emission at 612 nm. Therefore, the red chromaticity (x, y) in the thirty two gray scale levels or lower is (0.51, 0.28) which is improved more than the chromaticity (0.47, 0.27) not using the second coloring light sources.

In the first embodiment, although the criterion gray scale level range is set to the thirty two gray scale levels or lower, it is obvious that the gray scale level range is not limited only thereto, but it may be optimized in accordance with the initial gamma characteristics of the liquid crystal panel, a color temperature of the white color light sources, the characteristics of polarizers and color filters used with the liquid crystal panel.

Second Embodiment

In the second embodiment, the condition of changing the intensity of the second coloring light sources for red is added to the first embodiment. If the average luminance of input image signals is thirty two gray scale levels or lower and the maximum luminance is eighty eight gray scale levels or lower, the intensity of the first white color light sources is reduced by a half, and the intensity of the second coloring light sources for red is changed to about 0.7 of the intensity of the first white color light sources in a full illumination state at 612 nm.

Figure 8:
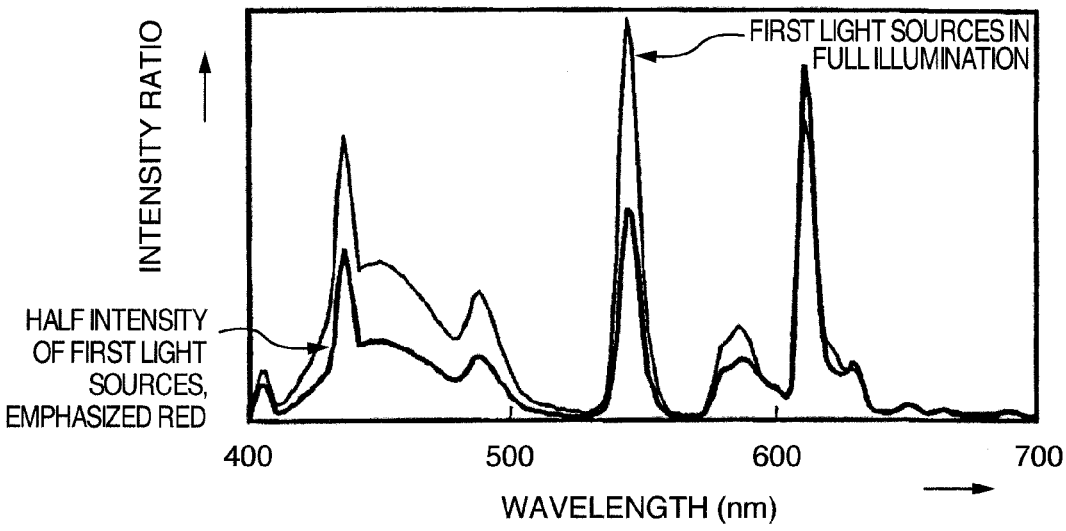
FIG. 8 is a graph showing the luminous characteristics of spectrum intensity ratios in a tone control of the light sources of a second embodiment.

FIG. 8 shows the luminous characteristics wherein a luminous intensity at a wavelength of 612 nm increases by about 70% relative to that at a wavelength of 544 nm. In FIG. 8, the luminous characteristics with the first white color light sources in the full illumination state are indicated by a narrow line, and the luminous characteristics with the intensity of the first white color light sources being reduced by a half and the second coloring light sources for red being turned on, are indicated by a bold line.

The luminous characteristics are stored in the light source look-up table of the image quality processing calculation circuit 2. If the input image signals are in the gray scale level range of the second embodiment, the image quality processing calculation circuit 2 refers to the light source control look-up table, and informs the light source control circuit 3 to reduce the intensity of the first white color light sources by a half and change the intensity of the second coloring light sources for red to about 0.7 of the intensity of the first white color light sources in a full illumination state at 612 nm.

The red chromaticity (x, y) in the thirty two gray scale levels or lower is (0.55, 0.29) indicating large improvements on the color purity. Considering the chromaticity (0.64, 0.32) at the red maximum luminance, it can be understood that the color purity is improved greatly.

Coloring of black is (0.22, 0.22) if the correction of the second embodiment is not performed, and the embodiment coloring of (0.29, 0.22) indicates great improvements. The comparison of brightness and luminance of black display shows that the luminance of black without correction is 1.1 $cd/m^2$ whereas the luminance of black of the embodiment is 0.73 $cd/m^2$, indicating a reduction by about 30% and contrast ratio improvements.

Third Embodiment

In the third embodiment, in addition to the configuration of the second embodiment, if the brightness (illuminance) of a peripheral environment is 50 lx or smaller, the intensity of the first white color light source is reduced by a half and the second coloring light source for red is turned on. In this case, if the average luminance of input image signals is thirty two gray scale levels or lower and the maximum luminance is eighty eight gray scale levels or lower, the light source control similar to that shown in FIG. 8 is performed to obtain the luminous characteristics.

Figure 9:
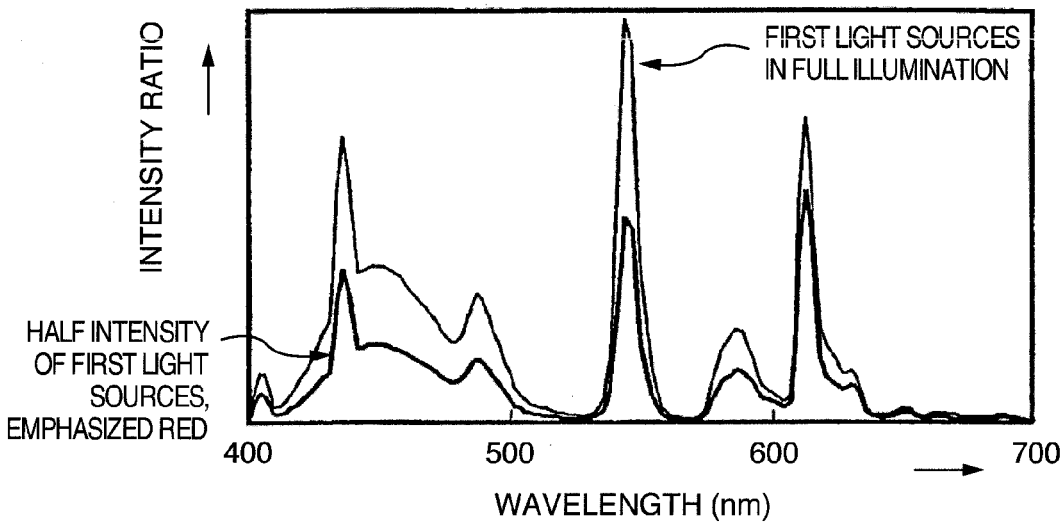
FIG. 9 is a graph showing the luminous characteristics of spectrum intensity ratios in a tone control of the light sources of a third embodiment.

In addition, if the average luminance of input image signals is thirty three gray scale levels or higher and the maximum luminance is eighty nine gray scale levels or higher, the luminous characteristics shown in FIG. 9 are set. The intensity of the second coloring light sources for red is set to about 0.3 of the intensity of the first white color light sources in the full illumination state at a wavelength of 612 nm. In this case, the luminous intensity at a wavelength of 612 nm increases by about 15% relative to that at a wavelength of 544 nm.

This embodiment provides a liquid crystal display apparatus by considering a color perception state if the human visual perception in the dim light vision and dark light vision has the spectral visual sensitivity characteristics indicated by a wave line shown in FIG. 6. In the liquid crystal display apparatus of this embodiment, the black chromaticity is visually recognized at (0.28, 0.25) so that more achromatic black can be perceived. Similarly, the red chromaticity at a low luminance is visually recognized at (0.60, 0.22) so that the chromaticity similar to the chromaticity gamut at a high luminance is visually recognized. A reduction in a color purity at the low luminance of the liquid crystal display apparatus can be improved drastically.

Fourth Embodiment

Figure 10:
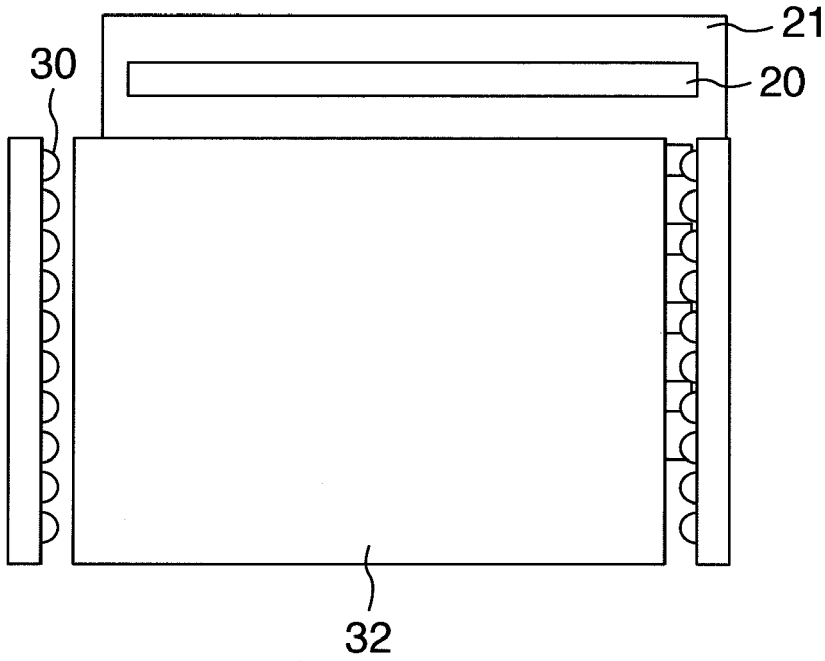
FIG. 10 is a diagram showing another structure of light sources according to the present invention.

In this embodiment, red light emitting diodes are used as the second coloring light sources 30. The outline of the light source unit is shown in FIG. 10. Three light emitting diodes were disposed at each of opposite sides for the size of a 28-inch liquid crystal panel. Although ten light emitting diodes are disposed at each of opposite sides in FIG. 10, the number of light emitting diodes may be changed as desired.

Figure 11:
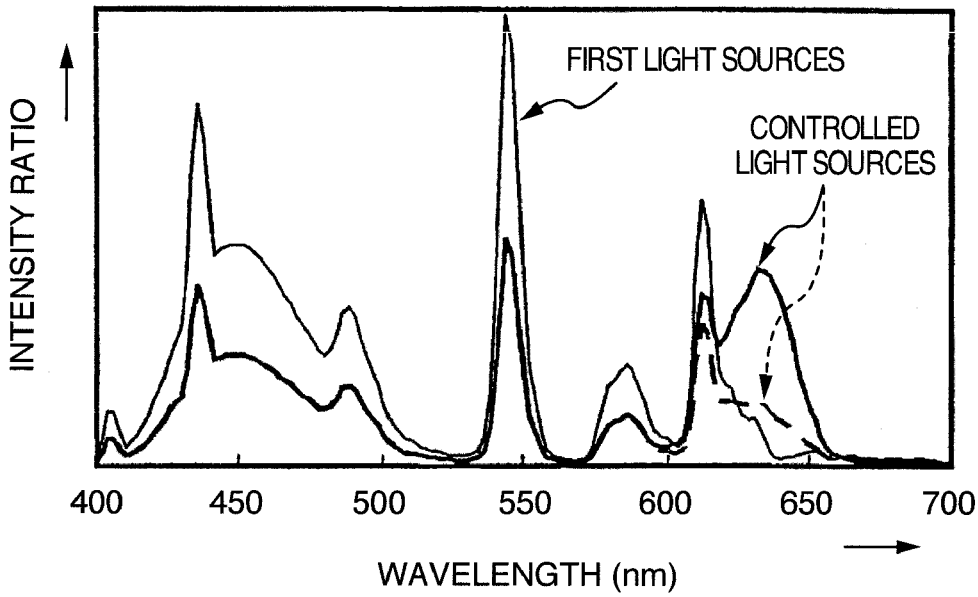
FIG. 11 is a graph showing the luminous characteristics of spectrum intensity ratios in a tone control of the light sources of a fourth embodiment.

In this embodiment, the chromaticity coordinates of the first white color light sources are (0.26, 0.23). Eight fluorescent lamps were used. If the average luminance of input image signals is thirty two gray scale levels or smaller and the maximum gray scale level is eighty eight or smaller, the intensity of the first white color light sources is suppressed by a half and the second coloring light sources (red) are changed as shown in FIG. 11 in accordance with the gray scale level. The chromaticity coordinates of the light sources can be controlled from the above-described chromaticity coordinates to (0.34, 0.24) as desired.

An in-plane switching type liquid crystal panel in a display mode utilizing a fringe electric field was used with $\Delta nd$ being set to 0.4 μm. This liquid crystal panel has the spectral characteristics shown in FIG. 5 showing the spectrum of a liquid crystal layer excluding the influence of color filters. This liquid crystal panel can increase transmission light, whereas it has a large reduction in the transmittance at a high luminance as shown in FIG. 5.

This problem is solved by this embodiment, by using only the first white color light sources at a high luminance to control the image quality. Namely, the white chromaticity coordinates are (0.28, 0.28) and rather bluish white can be displayed.

At a low luminance, the red intensity is gradually increased to perform correction in each gray scale level. The black chromaticity coordinates can be set to (0.28, 0.21) by setting the chromaticity coordinates of the light source to (0.34, 0.24) (by maximizing red of the second coloring light sources). If the compensation by this embodiment is not performed, the black chromaticity coordinates are (0.22, 0.19), indicating the remarkable effects of this embodiment.

As to the black luminance, the black luminance without correction is 0.87 cd/m$^2$, whereas the black luminance of this embodiment is 0.56 cd/m$^2$ resulting in a reduction of about 35%. A contrast ratio improvement effect can therefore be enhanced further.

Fifth Embodiment

In this embodiment, blue and red light emitting diodes are used as the second coloring light sources. The structure of the liquid crystal panel is similar to the fourth embodiment. The layout of the light emitting diodes is similar to the fourth embodiment. A ratio between blue and red light emitting diodes is 3:1. Six blue light emitting diodes and two red light emitting diodes are disposed at each of opposite sides. The layout is in the order of blue, blue, red, blue, blue, red, blue and blue. If a liquid crystal panel of a large size is to be used, the number of light emitting diodes is changed as desired.

Figure 12:
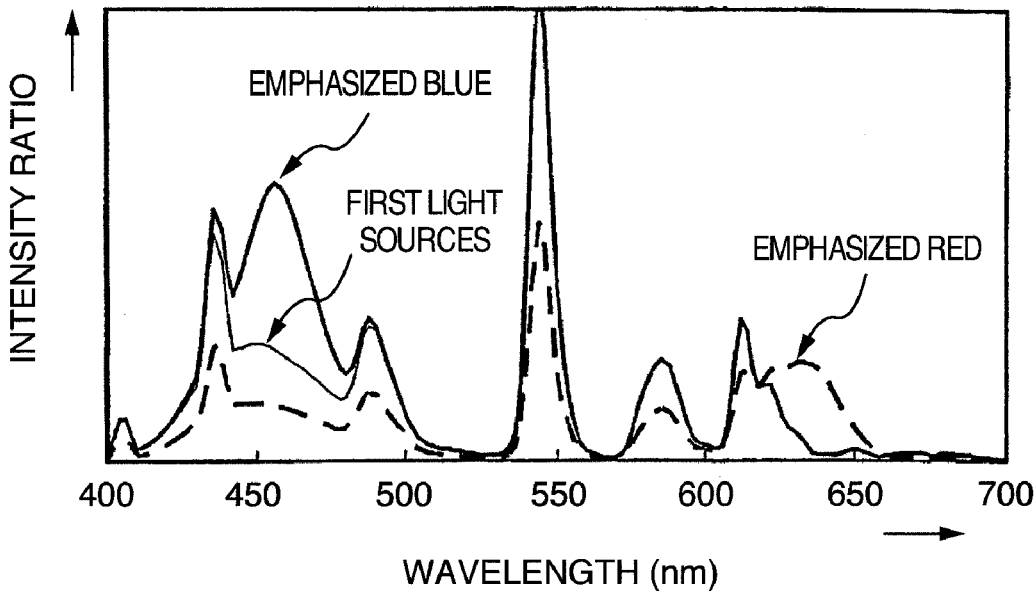
FIG. 12 is a graph showing the luminous characteristics of spectrum intensity ratios in a tone control of the light sources of a fifth embodiment.

The first white color light sources of this embodiment have spectra shown in FIG. 12 and the chromaticity coordinates of (0.28, 0.30). As compared to the first white color light sources of the first embodiment, the first white color light sources of this embodiment have the maximum luminous intensity of green phosphor stronger than that of red and blue phosphor. The second coloring light sources are not turned on or off, but they are always turned on to perform light control. A large tone change to be caused by turning on and off the light sources disappears so that the image quality processing calculation can be performed easily.

The second coloring light sources are controlled independently in accordance with image signals. In one straightforward example, in order to mostly emphasize blue in white display, only blue is made in a full illumination state to obtain a blue emphasized spectrum shown in FIG. 12. In order to mostly emphasize red in black display, only red is made in a full illumination state to obtain a red emphasized spectrum.

Figure 13:
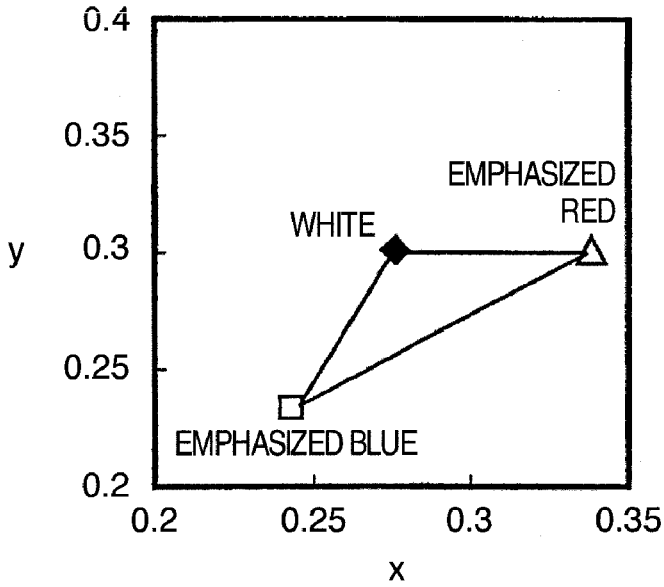
FIG. 13 is a diagram illustrating the effects of a tone control of the light sources of a sixth embodiment.

It is also possible to control the intensity of both blue and red, and the tone of the light sources can be controlled in a gamut shown in FIG. 13. In accordance with image signals, the image quality processing calculation circuit controls the liquid crystal panel and light sources to obtain an optimum tone in each gray scale level.

Sixth Embodiment

This embodiment has the configuration similar to that of the first embodiment, excepting that one blue fluorescent lamp and one red fluorescent lamp are disposed on opposite sides. The blue and red fluorescent lamps of the second coloring light sources are controlled at the same time.

Figure 14:
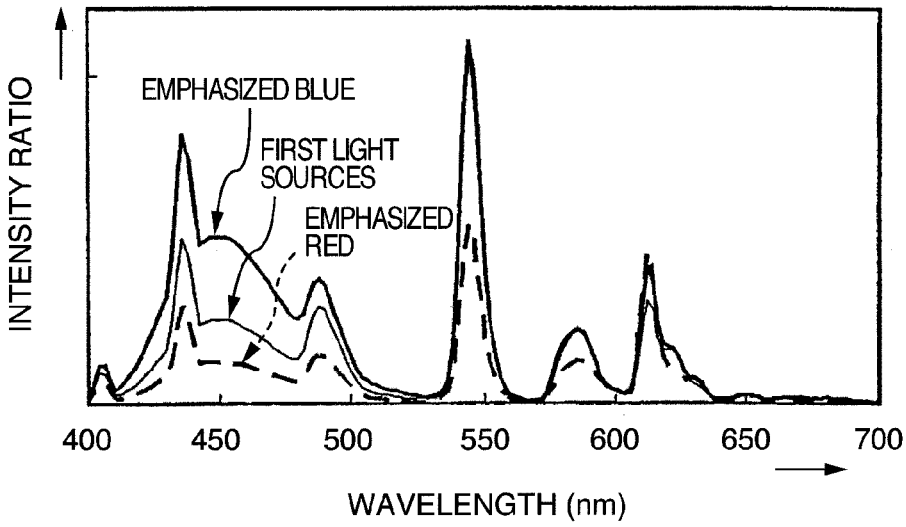
FIG. 14 is a graph showing the luminous characteristics of spectrum intensity ratios in a tone control of the light sources of a sixth embodiment.

The luminous characteristics of the light sources of this embodiment are shown in FIG. 14. If image signals are at a black to very low luminance, only red is turned on to emphasize red and the intensity of the first white color light sources is reduced by a half. In this case, the chromaticity coordinates are (0.33, 0.31). If image signals are at a high luminance, blue is made in a full illumination state to emphasize blue, and the red intensity is adjusted. In this case, the chromaticity coordinates are (0.24, 0.23), and the intensity of the light sources is 12000 cd/m$^2$ as compared to 10500 cd/m$^2$ of only the first white color light sources. Since the luminance is increased by about 15%, the white luminance is increased correspondingly. If the average luminance of input image signals is one hundred and ninety gray scale levels or higher, the image quality processing calculation circuit 2 shown in FIG. 2 refers to the image control look-up table, corrects the gamma characteristics of the image signals, and supplies the image control circuit 4 with the image control signal including the corrected image signals and horizontal/vertical sync signals for scanning the liquid crystal panel 10. At the same time, the image quality processing calculation circuit 2 refers to the light source control look-up table, and supplies the light source control circuit 3 with the light source control signal to emphasize blue of the second coloring light sources.

If image signals are in a low gray scale level, red is made in a full illumination state and the blue intensity is controlled to allow the chromaticity coordinates to be set to (0.29, 0.26) and the adjustment range matching image signals to be broaden. The image quality processing calculation circuit of the liquid crystal display apparatus sets (0.29, 0.21) for black and (0.26, 0.28) for white. Black can therefore be displayed by considering the Purkinje phenomena. The red chromaticity coordinates in a low gray scale level can be set to (0.53, 0.29) and the achromatic color chromaticity coordinates can be set to (0.28, 0.28), resulting in a good image quality.

Seventh Embodiment

Figure 15:
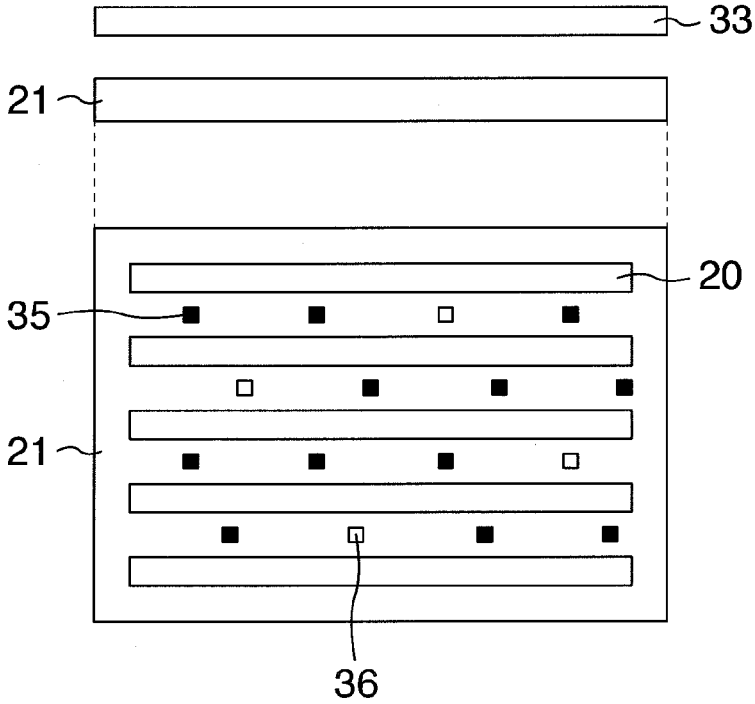
FIG. 15 is a diagram showing another structure of light sources according to the present invention.

In this embodiment, as shown in FIG. 15, organic ELs 35 and 36 are used as the second coloring light sources 30, and the second coloring light sources 35 and 36 are disposed just under the liquid crystal panel similar to the first white color light sources 20. An odd number of fluorescent lamps are used as the first white color light sources 20. The organic ELs are disposed between the fluorescent lamps. The liquid crystal panel of this embodiment is of a 28-inch size and nine fluorescent lamps are used (although only five fluorescent lamps are shown in FIG. 15). Reference numeral 35 represents a blue organic EL and reference numeral 36 represents a red organic EL. The ratio between blue and red is set to 3:1, and in this layout, red organic ELs are disposed not to be adjacent to each other as viewed from both short and longer sides.

Figure 16:
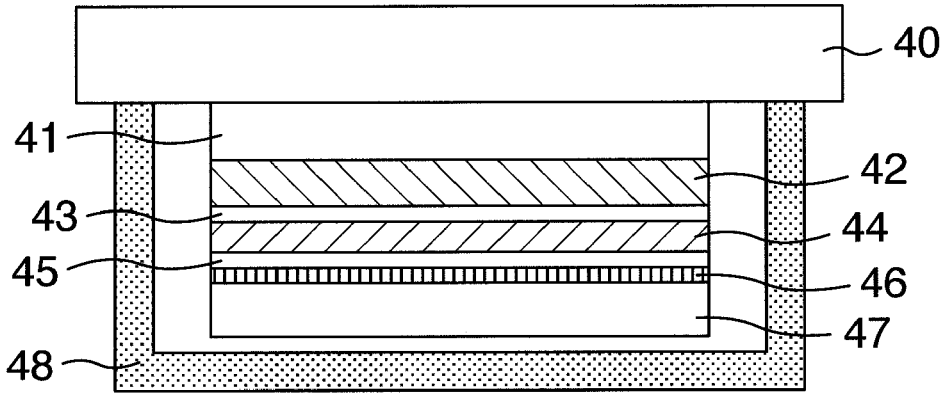
FIG. 16 is a diagram showing the structure of an organic EL element used as second coloring light sources according to the present invention.

The organic EL has a bottom emission structure shown in FIG. 16. On a clean glass substrate 40, an anode 41 of an ITO thin film is formed. Sequentially formed on the anode 41 are thin films including a hole injection layer 42, a hole transport layer 43, a luminous layer 44, an electron transport layer 45, a lithium fluoride layer 46 and a cathode 47 of aluminum. These elements are sealed with a sealing tube 48.

A 2 mm square 4×4 matrix device of organic ELs is disposed in a back light case 21. Although the matrix layout, organic ELs are turned on at the same time and not time divisionally driven. The 2 mm square maintains a margin for foreign matter mixture during manufacture. The organic EL device is driven at constant current. Although not shown, wirings of electrodes are disposed just under the fluorescent lamps of the first white color light sources. Diffusion/reflection of the first white color light sources 20 in the back light case 21 is therefore not prevented.

Figure 17:
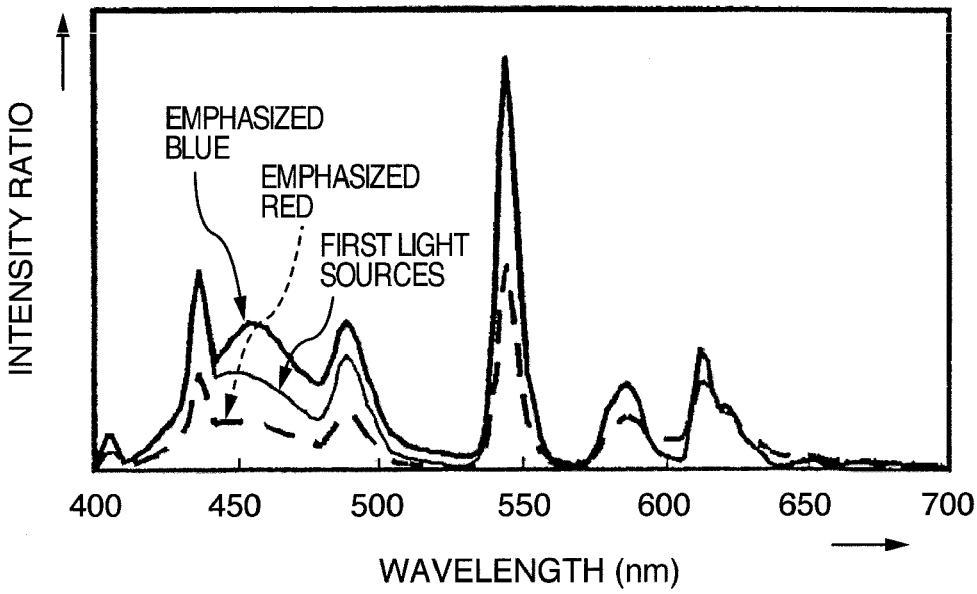
FIG. 17 is a graph showing the luminous characteristics of spectrum intensity ratios in a tone control of the light sources of a seventh embodiment.

FIG. 17 shows spectra of the luminance and tone control of the light sources. The chromaticity coordinates of the light sources are (0.25, 0.28) at the maximum blue emphasis and (0.33, 0.31) at the maximum red emphasis. It can be understood that the effects of the present invention can be obtained without any limitation on the type of the second coloring light sources. The structure of the organic EL device is not limited to this embodiment, but a top emission type or a multiphoton type optimum to the light sources may be also be used.

Eighth Embodiment

Figure 18:
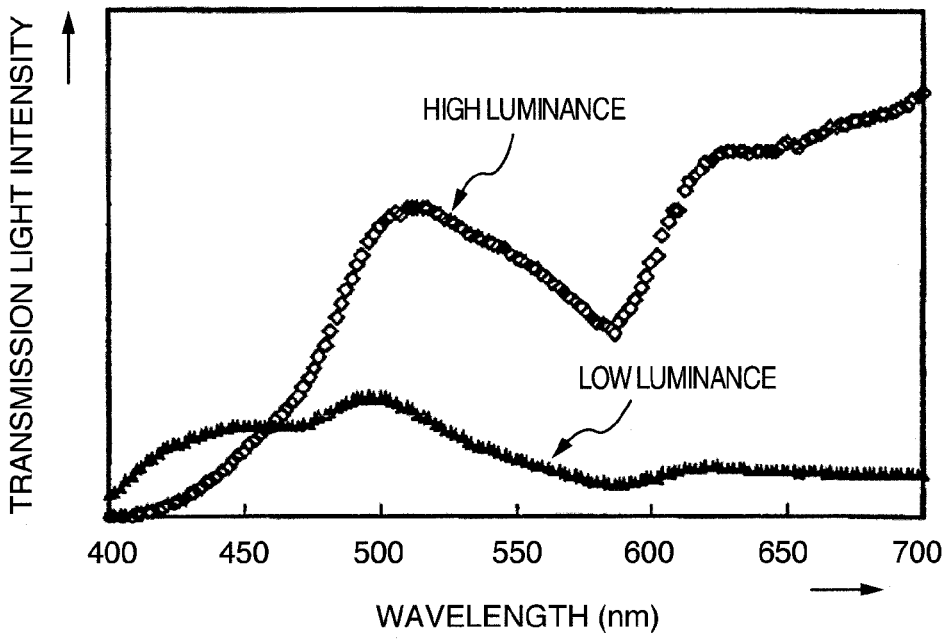
FIG. 18 is a diagram showing the spectral characteristics of a vertical alignment mode liquid crystal panel.

In this embodiment, a vertical alignment type liquid crystal panel is used whose transmission characteristics are shown in FIG. 4. The liquid crystal panel has Δnd set to 0.4 μm. FIG. 18 shows the spectral characteristics at a high luminance and low luminance. The ordinate represents a transmission light intensity involving color filters. It can be seen that the characteristics that blue at a low luminance and yellowish at a high luminance, are remarkable. The vertical alignment type liquid crystal panel of this embodiment is a PVA mode liquid crystal panel using slits of a transparent electrode. However, an MVA mode using projections may also be used.

Figure 19:
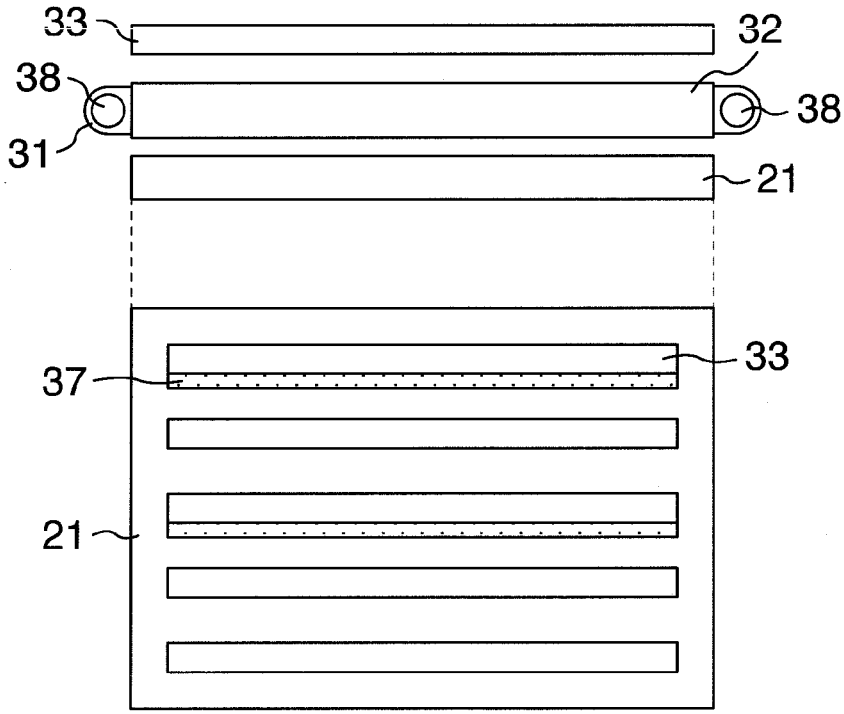
FIG. 19 is a diagram showing another structure of light sources according to the present invention.

The structure of the light sources is shown in FIG. 19. Blue fluorescent lamps 37 of the second coloring light sources are disposed along the first white color light sources 20 just under the liquid crystal panel, the number of blue fluorescent lamps being a half or a half and one of the number of first white color light sources. Red fluorescent lamps 38 of the second coloring light sources are of a light pipe type. Although not shown, inverters interconnect blue fluorescent lamps together and red fluorescent lamps together. Blue emphasis can therefore be made more remarkably.

Figure 20:
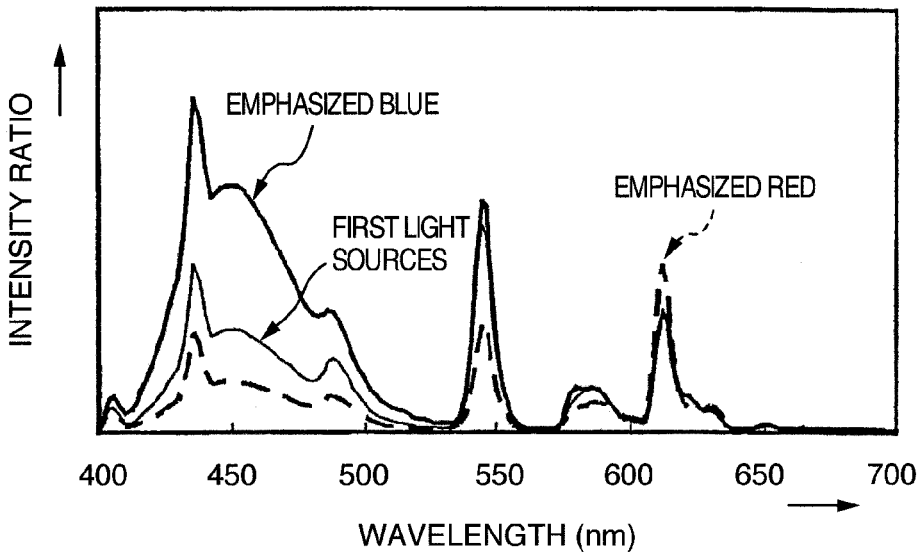
FIG. 20 is a graph showing the luminous characteristics of spectrum intensity ratios in a tone control of the light sources of an eighth embodiment.

FIG. 20 shows spectra of the first white color light sources and the blue emphasis and red emphasis of the light sources. The chromaticity coordinates of the first white color light sources are (0.26, 0.23) and at the maximum blue emphasis they are (0.21, 0.16). If a color temperature is raised by using one type of fluorescent lamps, there are side effects that an efficiency and a luminance are lowered. In this embodiment, a maximum luminance of 13800 cd/m$^2$ can be obtained although the luminance of only the first white color light sources is 11000 cd/m$^2$, increasing by about 25%. It can be understood that a high color temperature and a high luminance can be realized by the light sources. The chromaticity coordinates at a maximum red emphasis are (0.32, 0.25).

White can be displayed on the vertical alignment type liquid crystal panel by using a drive voltage at which a maximum transmittance of the liquid crystal layer is obtained. Namely, in this embodiment, the white chromaticity coordinates of (0.28, 0.31) can be realized in the spectral characteristics shown in FIG. 18. If the second coloring light sources of this embodiment are not used, the chromaticity coordinates are (0.35, 0.38), resulting in a visual recognition of not white but yellow. The red chromaticity coordinates of (0.60, 0.29) can be realized at a low luminance, and (0.24, 0.16) is realized for black. If the correction by the second coloring light sources for red is not performed, the black chromaticity coordinates are (0.19, 0.14). It can be understood that this embodiment improves considerably.

In this embodiment, although fluorescent lamps of the second coloring light sources are used, it is obvious that they can be replaced with light emitting diodes. Light emitting diodes are more effective because they have a high color purity of both blue and red.

Ninth Embodiment

Figure 21:
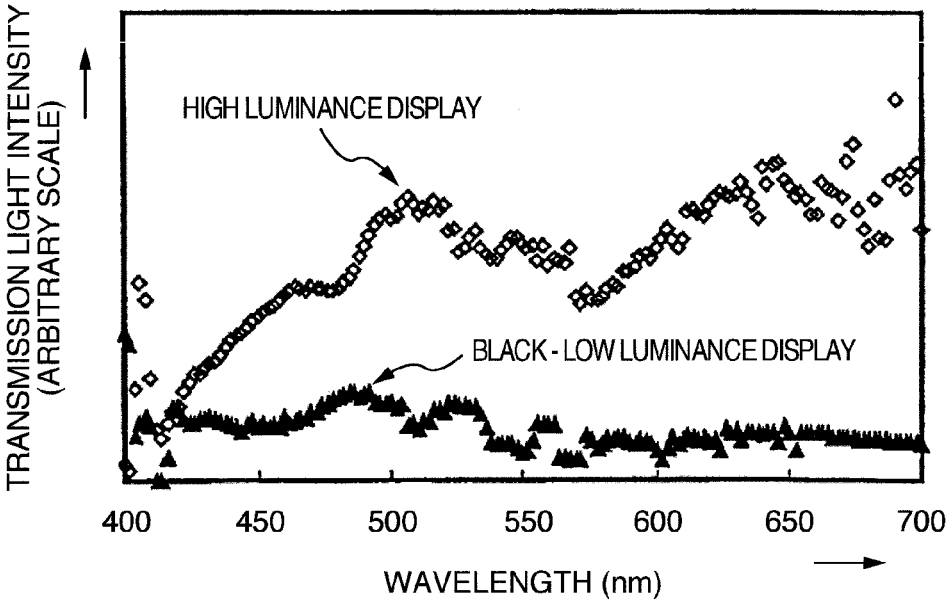
FIG. 21 is a diagram showing the spectral characteristics of a liquid crystal panel with color filters.

In this embodiment, a liquid crystal panel is used whose pixel is constituted of subsidiary pixels of red, green, blue, and white. A pixel is divided into four squares, two subsidiary pixels at an upper stage and two subsidiary pixels at a lower stage. An in-line switching type liquid crystal panel in a display mode utilizing a fringe electric field was used. The liquid crystal panel has Δdn set to 0.4 μm. FIG. 21 shows the spectral characteristics of the liquid crystal panel with color filters. A transmittance at a black to low luminance is displayed being enlarged by ten times.

The second coloring light sources shown in FIG. 1 of a light pipe type are used. Two blue fluorescent lamps of the second coloring light sources 30 are disposed at each of opposite sides of a light pipe 32. In the liquid crystal panel of this embodiment, a color shift to blue in black display is suppressed because of the effects of the white subsidiary pixel without the color filter, so that the second coloring light sources 30 only for blue can be used.

If the average luminance of image signals is one hundred and forty gray scale levels or higher and the maximum luminance is two hundreds gray scale levels or higher, blue fluorescent lamps of the second coloring light sources 30 are tuned on. The chromaticity coordinates of the first white color light sources 20 are (0.29, 0.26). The chromaticity coordinates with a blue emphasis are (0.26, 0.21). The maximum luminance of only the first white color light sources is 10500 cd/m$^2$, whereas the light source luminance with the blue emphasis is 11500 cd/m$^2$, increasing by about 10%.

Figure 22:
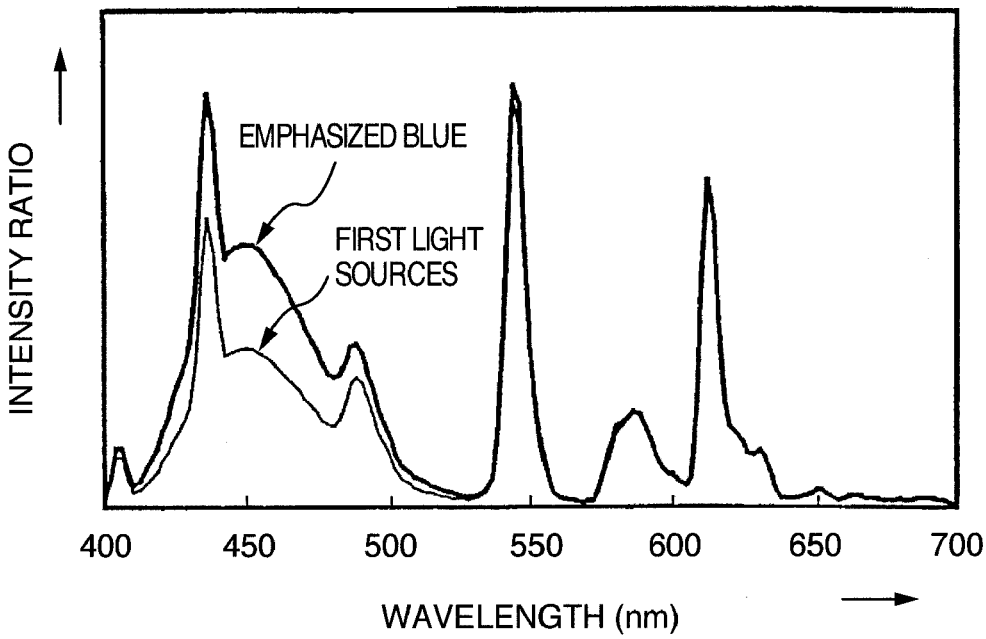
FIG. 22 is a graph showing the luminous characteristics of spectrum intensity ratios in a tone control of the light sources of a ninth embodiment.

FIG. 22 shows spectra of the light sources of this embodiment. The white chromaticity coordinates with a blue emphasis of this embodiment are (0.29, 0.26) and the black chromaticity with the intensity of the white color light sources 20 being suppressed to a half are (0.25, 0.21).

In this embodiment, although the color temperature is set high, if a color temperature for a liquid crystal television is to be lowered, the first white color light sources 20 are changed to those having a low color temperature or the intensity of the second coloring light sources 30 is weakened.

The reason why the image quality has no problem even if the blue light sources are turned on upon judgement by the maximum luminance of image signals, is as follows. Visual perception of human eyes always observes a relative contrast ratio which is said to be about 200:1. Therefore, if there is a high luminance image portion, visual senses for black become weak. Therefore, in this embodiment, if the maximum luminance is two hundreds gray scale levels or higher, coloring a dark image portion is hardly recognized even if blue light sources are turned on. The effects are therefore obtained even if the second coloring light sources 30 only for blue are used.

If the second coloring light sources 30 for both blue and red are used, the effects are further enhanced, as apparent from the above-described embodiments. If the control is executed in accordance with brightness of a peripheral environment, it is becomes effective if the Purkinje phenomena is considered.

If the liquid crystal panel has white subsidiary pixels, the image quality processing calculation circuit can optimize an image signal applied to the white subsidiary pixel in order to correct a color purity. In this embodiment, although fluorescent lamps are used as the second coloring light sources 30, light emitting diodes may also be used without any problem. Even if the light pipe is used, the second coloring light sources 30 can be disposed along the first white color light sources 20. If higher luminance light sources are necessary, it is effective to dispose the second coloring light sources along the first white color light sources 20.

Tenth Embodiment

Figure 23:
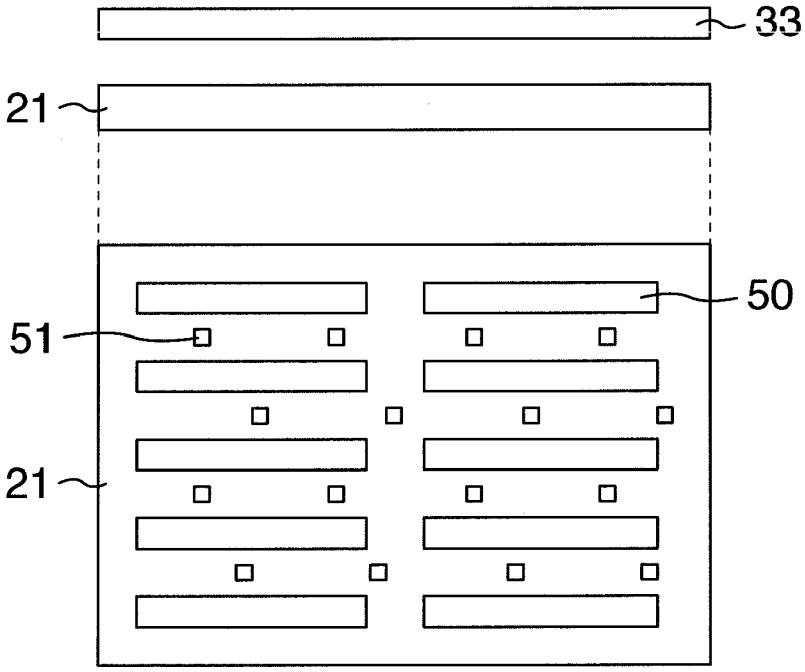
FIG. 23 is a diagram showing another structure of light sources according to the present invention.

Light sources disposed on the back side of a liquid crystal display panel of this embodiment shown in FIG. 23 include white color light emitting diodes 50 as the second white color light sources disposed just under the liquid crystal panel and red and blue light emitting diodes 51 as the second coloring light sources.

The while color light emitting diodes 50 are disposed in an elongated back light case 21. The layout order is green, blue, green, green, red, blue, green, green, red, blue green, green, red, blue, green, green, red, and green. Namely, one repetition unit is constituted of blue, green, green and red four light emitting diodes disposed in series, four repetition units are disposed in series, and one green light emitting diode is disposed on both ends of the four repetition units to constitute one unit. The second coloring light sources 51 are disposed between the first white color light sources 50. A vertical alignment type liquid crystal panel is used as the liquid crystal panel, and image quality processing calculation is approximately similar to that of the eighth embodiment. The intensity of the first white color light sources is controlled not by current drive but by time division modulation.

Eleventh Embodiment

Figure 24:
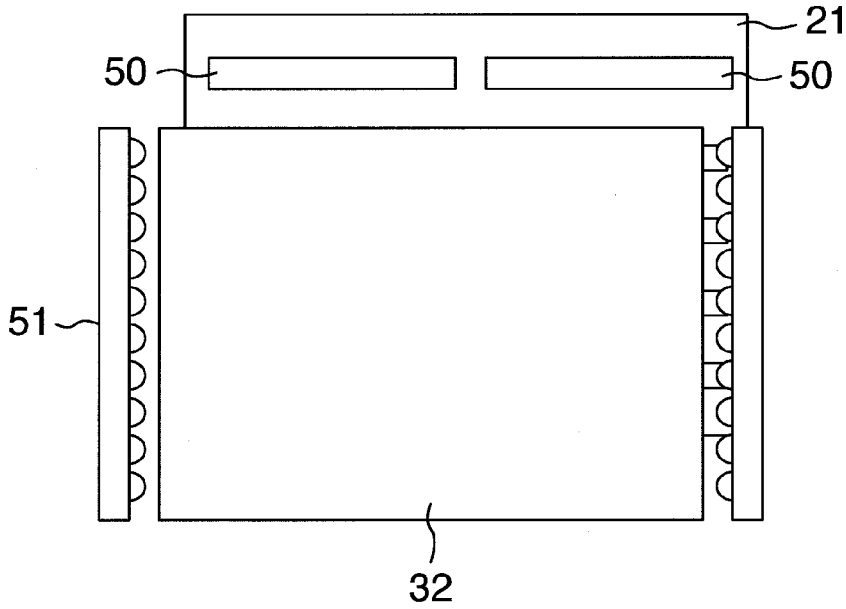
FIG. 24 is a diagram showing another structure of light sources according to the present invention.

Light sources disposed on the back side of a liquid crystal display panel of this embodiment shown in FIG. 24 include white color light emitting diodes 50 as the second white color light sources disposed just under the liquid crystal panel and red and blue light emitting diodes 51 as the second coloring light sources.

The while color light emitting diodes 50 are disposed in an elongated back light case 21. The layout order is green, blue, green, green, red, blue, green, green, red, blue green, green, red, blue, green, green, red, and green. Namely, one repetition unit is constituted of blue, green, green and red four light emitting diodes disposed in series, four repetition units are disposed in series and one green light emitting diode is disposed on both sides of the four repetition unit to constitute one unit. The layout of the light emitting diodes as the second coloring light sources is similar to that of the fourth embodiment, and the ratio between blue and red is 3:1. Six light emitting diodes and two red light emitting diodes are disposed on opposite sides to obtain a layout order of blue, blue, red, blue, blue, red, blue and blue. Image quality processing calculation is approximately similar to that of the fifth embodiment. The intensity of the first white color light sources is controlled by time division modulation.

Twelfth Embodiment

This embodiment uses the light source unit having both the first and second light sources disposed just under the liquid crystal panel 10 and a diffusion plate disposed to mix light of both the first and second light sources. In the schematic diagram of FIG. 15 showing the light source unit of this embodiment, red light emitting diodes are used for the second light sources 35 and 36. The structure of the light source unit is the same as that of the fourth embodiment, excepting the layout of the second light sources and a higher color temperature of the first light sources, i.e., the chromaticity coordinates of (0.22, 0.24).

Figure 26:
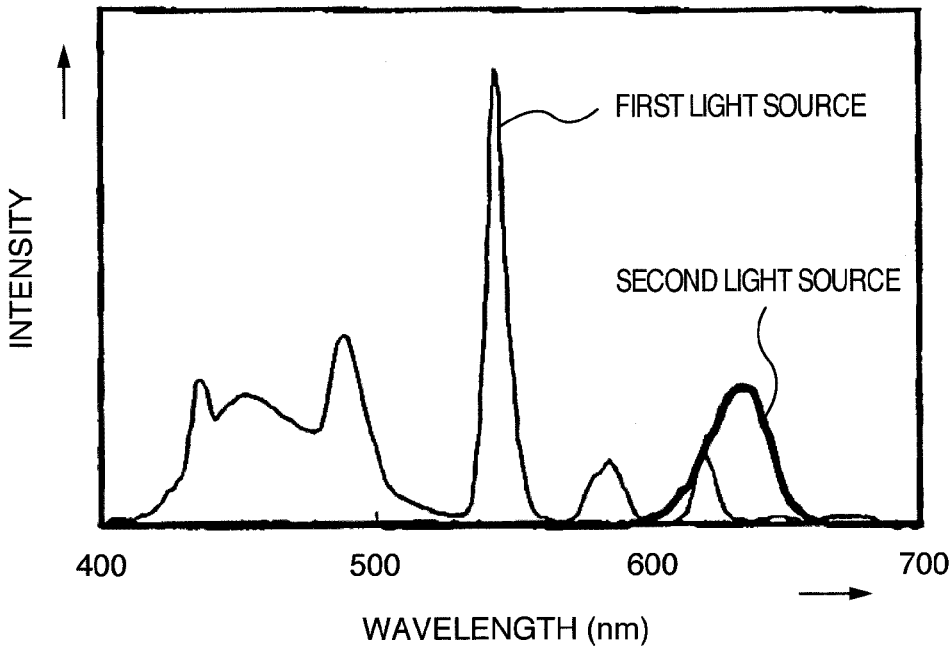
FIG. 26 is a diagram showing the light emission characteristics of the first and second light sources of twelfth and thirteenth embodiments.

FIG. 26 shows the light emission spectra of the first and second light sources of this embodiment. The chromaticity coordinates of the second light sources are (0.70, 0.30). If the intensity of the first light sources are not changed and the intensity of the second light sources are controlled, it is possible to change the chromaticity coordinates of the light source for applying light to the liquid crystal panel can be changed between (0.22, 0.24) and (0.26, 0.25). The former is obtained when only the first light sources are turned on, and the latter is obtained when the second red color light sources are turned on in a full illumination. This embodiment is applied to the case in which the luminance level of an input image signal is higher than 88-th gray scale level. If the intensity of the second light sources is reduced by a half and the intensity of the second light sources is controlled, it is possible to change the chromaticity coordinates between (0.30, 0.25) and (0.22, 0.24). The former is obtained when the second light sources are turned on in a full illumination, and the latter is obtained when only the first color light sources are turned on. Although the light sources can be controlled in this range, if the luminance of the light sources is reduced, the embodiment is applied in the chromaticity coordinates range between (0.30, 0.25) and (0.26, 0.25). Although the embodiment is applied to an input image signal luminance level of 88-th gray scale level, the full illumination of the second light sources is applied to the case in which signals at the 31-st gray scale level or lower are 70% or more and the maximum luminance is 62-nd gray scale level or lower. The standard gray scale level is not limited to the embodiment, but it may be optimized as desired in accordance with the design criterion such as the characteristics of the liquid crystal panel, priority of preference color reproduction, priority of fidelity color reproduction and the like.

The chromaticity coordinates of the standard light source C of full-pixel display, i.e., white display, of the liquid crystal panel of this embodiment are (0.32, 0.36) and the chromaticity coordinates of the standard light source C of black display are (0.26, 0.31). If the color tone of the light source is not corrected, the chromaticity coordinates of the black display changes greatly to (0.23, 0.22) although the chromaticity coordinates of the white display are (0.28, 0.29). With the structure of this embodiment, a color tone change between white and black gray scale levels can be corrected by the light source so that the white display can be improved to (0.28, 0.29) and the black display can be improved to (0.27, 0.240). With the structure of the embodiment, although the second red light sources are turned on in a full illumination for the black display, an increase in the luminance of the black display of the liquid crystal display apparatus is very small and it is possible to sufficiently retain the effects of improving a contrast ratio by reducing the luminance of the black display by reducing the luminance of the first light sources. The luminance of the black display of the embodiment is 0.33 cd/m$^2$. If the color tone is not corrected, i.e., if the luminance of the second light sources are reduced by a half similar to the first light sources, the luminance is 0.31 cd/m$^2$, posing no problem. Since the luminance of the black display is 0.61 cd/m$^2$ if the light source luminance is set to the same as that of the white display, the luminance reduction effects of the black display can be obtained sufficiently. The contrast ratio can be effectively improved only by reducing the luminance without performing the color tone correction.

The light source may be controlled in a similar manner even in a dark environment having a neighboring brightness of 50 lux or smaller measured with a neighboring brightness detection circuit. In this case, the luminance of the second light sources may be reduced by a half similar to the first light sources, independently from the image signal and without controlling the color tone by the second light sources.

In this embodiment, only blue and green phosphors are used in order to set high the color temperature of the first light sources. With this structure, it is possible to control the high luminance display only by the second red light sources with ease. Green phosphor has subsidiary light emissions near 588 nm and 620 nm as indicated by a narrow line in FIG. 26. It is therefore possible to use green phosphor as the first light sources having a high color temperature without using red phosphor. Blue and red light emission efficiencies of narrow peak band emitted phosphor are good, which is preferable in terms of a luminance efficiency. Since red light emitting diodes are used as the second light sources, the embodiment uses a combination of light sources having a high efficiency because light emitting diodes have a high efficiency for red. This structure is very preferable from the standpoint of consumption power. In the structure of the embodiment, the main light source for red display mainly depends on the light emitting diodes of the second light sources, and the color purity improving effects of the red display are high so that this structure is more preferable for high image quality.

Thirteenth Embodiment

Figure 27:
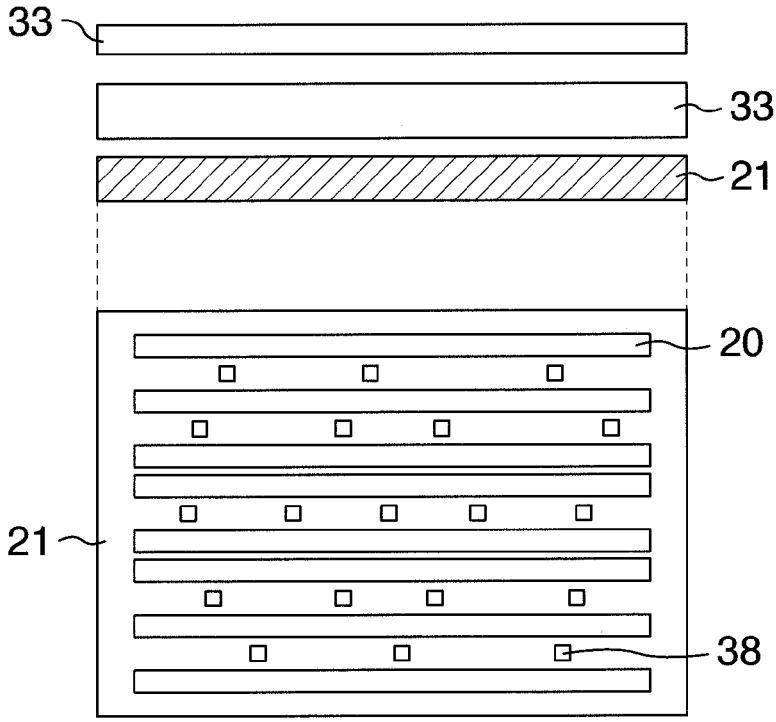
FIG. 27 is a schematic diagram showing the structure of a light source unit of the thirteenth embodiment.

This embodiment uses the light source unit having both the first and second light sources disposed just under the liquid crystal panel 10 and two diffusion plates disposed to mix light of both the first and second light sources. FIG. 27 is a schematic diagram showing the light source unit of the embodiment. The light emission spectra of the first and second light sources are the same as those of the twelfth embodiment. In this embodiment, as shown in FIG. 27, the first light sources are disposed in such a manner that light of a stronger intensity is applied to a central area of the liquid crystal panel. By using this layout, the light source intensity is controlled being optimized more to a television image signal. For example, the intensity of the first light sources is increased for the display requiring a peak luminance, for a television input image signal which uses the 225-th gray scale level as normal white display among 256 gray scale levels (0 to 255 gray scale levels), and 226-th to 255-th gray scale levels as peak luminance display. The first light sources control the luminance at three stages, 255-th to 226-th gray scale levels, 225-th to 88-th gray scale levels, and 88-th to 0 gray scale levels. In order to prevent the light source luminance from being reduced in the 225-th to 88-th gray scale levels, the first light sources are increased from twelve light sources to sixteen light sources. The additional light sources are disposed in the central area of the liquid crystal panel, by considering that high luminance requests of viewers are shifted to the central area of the liquid crystal panel. In order to set slightly high the intensity of the second light sources in the central area in accordance with the luminance, red light emitting diodes are disposed. When the luminance of the first light sources is increased for the peak luminance display, the luminance of the second red light sources may be or may not be controlled. This is because a sufficient luminance can be obtained only by increasing the luminance of the first light sources without increasing the luminance of the second red light sources, and because psychological visual effects are utilized in which bluish display having a high color temperature is viewed more effectively for high luminance display such as peak luminance. Since the first light sources of this embodiment are constituted of blue and green phosphors, it is possible to set a blue emphasized light source by increasing the intensity of the second red light sources. In this embodiment, it is obviously possible to raise a color temperature of the light source only by increasing the luminance of the second light sources without increasing/decreasing the intensity of the second red light sources, and to use a control signal for increasing the luminance of the second light sources if a higher luminance of the light source is necessary. The luminance of the first light sources may be increased in a similar manner in a bright environment having a neighboring brightness of 400 lux or larger measured with the neighboring brightness detection circuit.

Figure 28:
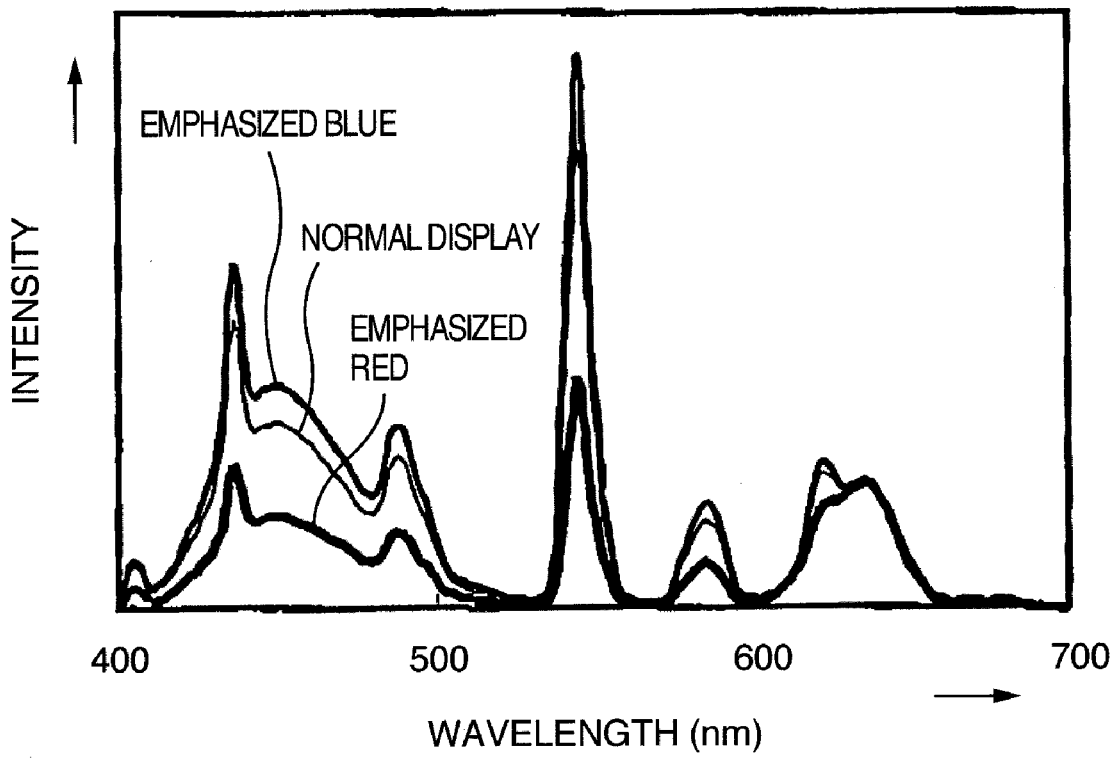
FIG. 28 is a diagram showing the light emission characteristics of a spectral intensity ratio of color tone control of the light source of the thirteenth embodiment.

In this embodiment, the maximum luminance of the light source (the luminance of the light source unit through the diffusion plates) is 11700 cd/m$^2$, the chromaticity coordinates are (0.255, 0.24), and high luminance display at a peak luminance of 600 cd/m$^2$ can be made in the liquid crystal display apparatus. The chromaticity coordinates of peak white display of the liquid crystal display apparatus were (0.275, 0.295). The light source luminance and chromaticity coordinates from normal white display to 88-th gray scale level were 9900 cd/m$^2$ and (0.26, 0.245), respectively, and 512 cd/m$^2$ and (0.283, 0.297) for white display of the liquid crystal display apparatus. The light source luminance and chromaticity coordinates for black display were 5500 cd/m$^2$ and (0.30, 0.25), respectively, and 0.33 cd/m$^2$ and (0.27, 0.23) for black display of the liquid crystal display apparatus. FIG. 28 shows light emission spectra of the light source under the above-described control conditions. In this embodiment, a peak luminance can be displayed and the image quality is improved considerably. The chromaticity coordinates of red are (0.66, 0.30). It can be known that the color purity improving effects are large, because the chromaticity coordinates of red of the comparative example are (0.64, 0.32). Upon comparison between green display and blue display, in this embodiment, the chromaticity coordinates were (0.28, 0.62) for green and (0.14, 0.07) for blue. It can be understood that the color purity is improved for both green and blue, because in the comparative example, the chromaticity coordinates were (0.29, 0.61) for green and (0.14, 0.078) for blue.

It should be further understood by those skilled in the art that although the foregoing description has been made on embodiments of the invention, the invention is not limited thereto and various changes and modifications may be made without departing from the spirit of the invention and the scope of the appended claims.

The invention claimed is:

1. A liquid crystal display apparatus comprising:

a white color light source and a coloring light source which irradiate light upon a liquid crystal panel for displaying an image;

a detection circuit which detects a brightness of an input image signal;

an image quality processing calculation circuit;

a light source control circuit; and an image control circuit;

wherein the coloring light source includes a blue light source, wherein the image quality processing calculation circuit outputs to the light source control circuit a light source control signal for increasing a light intensity of the coloring light source when an average luminance of the input image signal is detected to be higher than a predetermined luminance based on a detection result of the detection circuit;

wherein the image quality processing calculation circuit outputs to the light source control circuit a light source control signal for turning-on only the white color light source without turning-on the coloring light source when the average luminance of the input image signal is detected to be lower than the predetermined luminance based on the detection result of the detection circuit;

wherein the image quality processing calculation circuit outputs to the image control circuit an image control signal for controlling an image to be displayed on the liquid crystal panel; and wherein the light source control circuit independently controls turns-on and turn-off of each of the white color light source and the coloring light source based on the light source control signal.

2. The liquid crystal display apparatus according to claim 1, wherein the image quality processing calculation circuit outputs the light source control signal for independently controlling a light intensity of the white color light source and a light intensity of the coloring light source and outputs the image control signal for controlling an image to be displayed on the liquid crystal panel, based on the detection result of the detection circuit for detecting a brightness of the input image signal and a detection result of another detection circuit for detecting a peripheral brightness of the liquid crystal panel.

3. The liquid crystal display apparatus according to claim 1, wherein the white color light source includes a cold cathode fluorescent lamp made of narrow peak band emitted phosphor;

wherein the coloring light source further includes a red light source; and wherein the image quality processing calculation circuit outputs to the light source control circuit the light source control signal for reducing the light intensity of the white color light source and controlling the light intensity of a red light source when an average luminance of the input image signal is detected to be lower than the predetermined luminance and a maximum luminance of the input image signal is detected to be lower than another predetermined luminance.

4. The liquid crystal display apparatus according to claim 1, wherein the coloring light source is disposed at least one side of a light pipe disposed on a back side of the liquid crystal panel; and wherein the light pipe makes light from the white color source and light from the coloring light sources uniform so as to irradiate light to the back side of the liquid crystal panel.

5. The liquid crystal display apparatus according to claim 1, wherein the white color light source includes a cold cathode fluorescent lamp made of narrow peak band emitted phosphor; and wherein a diffusion plate is disposed on a back side of the liquid crystal panel, the diffusion plate mixing light from the white color light source and light from the coloring light source.

6. The liquid crystal display apparatus according to claim 1, wherein the white color light source includes a cold cathode fluorescent lamp made of narrow peak band emitted phosphor;

wherein the coloring light source includes different types of light emitting elements; and where at least one type of the light emitting elements is disposed at least one side of a light pipe disposed on a back side of the liquid crystal panel.

7. The liquid crystal display apparatus according to claim 4, wherein the white color light source includes a cold cathode fluorescent lamp made of narrow peak band emitted phosphor.

8. The liquid crystal display apparatus according to claim 4, wherein the white color light source includes an organic electro luminance element.

9. The liquid crystal display apparatus according to claim 4, wherein the white color light source includes a light emitting diode.

10. The liquid crystal display apparatus according to claim 1, wherein the liquid crystal panel has an in-plane switching mode and is a normally close type.

11. The liquid crystal display apparatus according to claim 1, wherein the liquid crystal panel has a vertical alignment mode and is a normally close type.

12. The liquid crystal display apparatus according to claim 1, wherein a pixel unit of the liquid crystal panel is constituted of red, green, blue subsidiary pixels with red, green and blue filters and a subsidiary pixel without color filter for displaying only transmission light intensity.

13. The liquid crystal display apparatus according to claim 1, wherein the white color light source includes light emitting diodes; and wherein the coloring light source includes blue light emitting diodes.

14. The liquid crystal display apparatus according to claim 1, wherein the white color light source includes light emitting diodes; and wherein the coloring light source includes blue light emitting diodes and red light emitting diodes.

* * * * *